US010037766B2

(12) United States Patent
Choo

(10) Patent No.: US 10,037,766 B2
(45) **Date of Patent: *Jul. 31, 2018**

(54) APPARATUS AND METHOD FOR GENERATING BANDWITH EXTENSION SIGNAL

(71) Applicant: SAMSUNG ELECTRONICS CO., LTD., Suwon-si (KR)

(72) Inventor: Ki-hyun Choo, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/676,209

(22) Filed: Aug. 14, 2017

(65) Prior Publication Data

US 2017/0345443 A1 Nov. 30, 2017

Related U.S. Application Data

(63) Continuation of application No. 15/142,949, filed on Apr. 29, 2016, now Pat. No. 9,734,843, which is a continuation of application No. 14/130,021, filed as application No. PCT/KR2012/005258 on Jul. 2, 2012, now Pat. No. 9,349,380.

(60) Provisional application No. 61/503,241, filed on Jun. 30, 2011.

(51) Int. Cl.

| | |
|---|---|
| ***G10L 19/02*** | (2013.01) |
| ***G10L 21/038*** | (2013.01) |
| ***G10L 19/032*** | (2013.01) |
| ***G10L 19/12*** | (2013.01) |

(52) U.S. Cl.
CPC ..... *G10L 21/038* (2013.01); *G10L 19/032* (2013.01); *G10L 19/12* (2013.01)

(58) Field of Classification Search
USPC ..... 704/203–228, 256–269, 278, 500, 503
See application file for complete search history.

(56) References Cited

U.S. PATENT DOCUMENTS

| | | | |
|---|---|---|---|
| 7,242,720 | B2 | 7/2007 | Sugiyama |
| 8,428,958 | B2 | 4/2013 | Sung |
| 9,043,215 | B2 | 5/2015 | Neuendorf et al. |
| 9,449,606 | B2 | 9/2016 | Rettelbach et al. |

(Continued)

FOREIGN PATENT DOCUMENTS

| | | | |
|---|---|---|---|
| CN | 1183513 | C | 1/2005 |
| JP | 56-50400 | A | 5/1981 |

(Continued)

OTHER PUBLICATIONS

Communication dated May 11, 2016, issued by the Taiwanese Patent Office in counterpart Taiwanese Patent Application No. 101123831.

(Continued)

*Primary Examiner* — Marcellus Augustin
(74) *Attorney, Agent, or Firm* — Sughrue Mion, PLLC

(57) ABSTRACT

An apparatus for generating a bandwidth extended signal includes an anti-sparseness processing unit to perform anti-sparseness processing on a low-frequency spectrum; and a frequency domain high-frequency extension decoding unit to perform high-frequency extension encoding in the frequency domain on the low-frequency spectrum on which the anti-sparseness processing is performed.

7 Claims, 15 Drawing Sheets

(56) References Cited

U.S. PATENT DOCUMENTS

| | | | | |
|---|---|---|---|---|
| 2004/0002856 | A1 | 1/2004 | Bhaskar et al. | |
| 2004/0028222 | A1 | 2/2004 | Sewell et al. | |
| 2005/0004803 | A1 | 1/2005 | Smeets et al. | |
| 2006/0247922 | A1* | 11/2006 | Hetherington | G10L 21/02 704/208 |
| 2006/0277042 | A1 | 12/2006 | Vos et al. | |
| 2011/0004479 | A1* | 1/2011 | Ekstrand | G10L 19/022 704/500 |
| 2011/0170711 | A1 | 7/2011 | Rettelbach | |
| 2011/0178795 | A1 | 7/2011 | Bayer et al. | |
| 2011/0216918 | A1* | 9/2011 | Nagel | G10L 21/038 381/98 |
| 2011/0264454 | A1 | 10/2011 | Ullberg et al. | |
| 2012/0010880 | A1* | 1/2012 | Nagel | G10L 19/18 704/205 |
| 2012/0065965 | A1 | 3/2012 | Choo et al. | |
| 2012/0288117 | A1 | 11/2012 | Kim et al. | |
| 2017/0345443 | A1* | 11/2017 | Choo | G10L 19/032 |

FOREIGN PATENT DOCUMENTS

| | | | |
|---|---|---|---|
| JP | 57-125999 | A | 8/1982 |
| JP | 2005-509928 | A | 4/2005 |
| JP | 2009-524108 | A | 6/2009 |
| JP | 2009-541790 | A | 11/2009 |
| JP | 2010-538317 | A | 12/2010 |
| JP | 2011-527455 | A | 10/2011 |
| JP | 2012-505423 | A | 3/2012 |
| WO | 99/12156 | A1 | 3/1999 |
| WO | 2005104094 | A1 | 11/2005 |
| WO | 2008/060068 | A1 | 5/2008 |
| WO | 2009029036 | A1 | 3/2009 |
| WO | 2012121638 | A1 | 9/2012 |

OTHER PUBLICATIONS

Communication dated Jun. 24, 2016, issued by the European Patent Office in counterpart European Patent Application No. 12804615.8.

Communication dated Apr. 28, 2015 issued by the State Intellectual Property Office of P.R. China in counterpart Application No. 201280042439.X.

Communication dated Apr. 30, 2015 issued by the Australian Government IP Australia in counterpart Application No. 2012276367.

Communication dated Dec. 19, 2014 issued by the Mexican Patent Office in counterpart Mexican Patent Application No. MX/a/2014/000161.

Communication dated Jan. 22, 2015 issued by the European Patent Office in counterpart European Patent Application No. 12804615.8.

Communication dated Feb. 17, 2015 issued by the Australian Intellectual Property Office in counterpart Australian Patent Application No. 2012276367.

Communication dated Mar. 3, 2015 issued by the Japanese Patent Office in counterpart Japanese Patent Application No. 2014-518822.

International Search Report (PCT/ISA/210) dated Jan. 31, 2013, issued in International Application No. PCT/KR2012/005258.

Communication dated May 5, 2015 issued by the Canadian Intellectual Property Office in counterpart Application No. 2,840,732.

Notice of Allowance received in parent U.S. Appl. No. 14/130,021 dated Jan. 21, 2016.

Office Action received in parent U.S. Appl. No. 14/130,021 dated Aug. 7, 2015.

Communication dated Oct. 17, 2017 by the Japan Patent Office in counterpart Japanese Patent Application No. 2016-170949.

* cited by examiner

APPARATUS AND METHOD FOR GENERATING BANDWITH EXTENSION SIGNAL

CROSS-REFERENCE TO RELATED APPLICATIONS

This is a continuation of U.S. application Ser. No. 15/142,949, filed Apr. 29, 2016, which is a continuation of U.S. application Ser. No. 14/130,021, filed Mar. 11, 2014 and issued as U.S. Pat. No. 9,349,380 on May 24, 2016, which is a 371 of International Application No. PCT/KR2012/005258 filed Jul. 2, 2012, claiming priority from U.S. Provisional Application No. 61/503,241 filed Jun. 30, 2011 in the U.S. Patent and Trademark Office, the disclosures of which are incorporated herein by reference.

1. TECHNICAL FIELD

Apparatuses and methods consistent with exemplary embodiments relates to audio encoding and decoding, and more particularly, to an apparatus and a method for generating a bandwidth extended signal, capable of reducing metal-like noise of a bandwidth extended signal for a high-frequency band, an apparatus and a method for encoding an audio signal, an apparatus and a method for decoding an audio signal and a terminal, which employs the same.

2. BACKGROUND ART

A signal corresponding to a high-frequency band is less sensitive to a fine structure of frequencies in comparison to a signal corresponding to a low-frequency band. Accordingly, in order to increase coding efficiency to cope with restrictions of allowable bits when an audio signal is encoded, a signal corresponding to a low-frequency band is encoded by allocating a relatively large number of bits and a signal corresponding to a high-frequency band is encoded by allocating a relatively small number of bits.

The above-described method is used in spectral band replication (SBR). In SBR, a lower band of a spectrum, e.g., a low-frequency band or a core band, is encoded and an upper band, e.g., a high-frequency band, is encoded by using parameters, e.g., an envelope. SBR uses correlations between lower and upper bands such that characteristics of the lower band are extracted to predict the upper band.

In SBR, an improved method for generating a bandwidth extended signal for a high-frequency band is required.

SUMMARY

Aspects of one or more exemplary embodiments provide an apparatus and a method for generating a bandwidth extended signal, capable of reducing metal-like of a bandwidth extended signal for a high-frequency band, an apparatus and a method for encoding an audio signal, an apparatus and a method for decoding an audio signal and a terminal, which employs the same.

According to an aspect of one or more exemplary embodiments, there is provided a method of generating a bandwidth extended signal, the method including performing anti-sparseness processing on a low-frequency spectrum; and performing high-frequency extension encoding in the frequency domain on the low-frequency spectrum on which the anti-sparseness processing is performed.

According to another aspect of one or more exemplary embodiments, there is provided an apparatus for generating a bandwidth extended signal, the apparatus including an anti-sparseness processing unit to perform anti-sparseness processing on a low-frequency spectrum; and a frequency domain high-frequency extension decoding unit to perform high-frequency extension encoding in the frequency domain on the low-frequency spectrum on which the anti-sparseness processing is performed.

Metallic noises caused by emphasis of tone components may be reduced by performing an anti-sparseness processing on a signal used for extension of a high-frequency band, which results in the reduction of spectrum holes generated in the high-frequency extended signal.

DETAILED DESCRIPTION OF EXEMPLARY EMBODIMENTS

Figure 1:
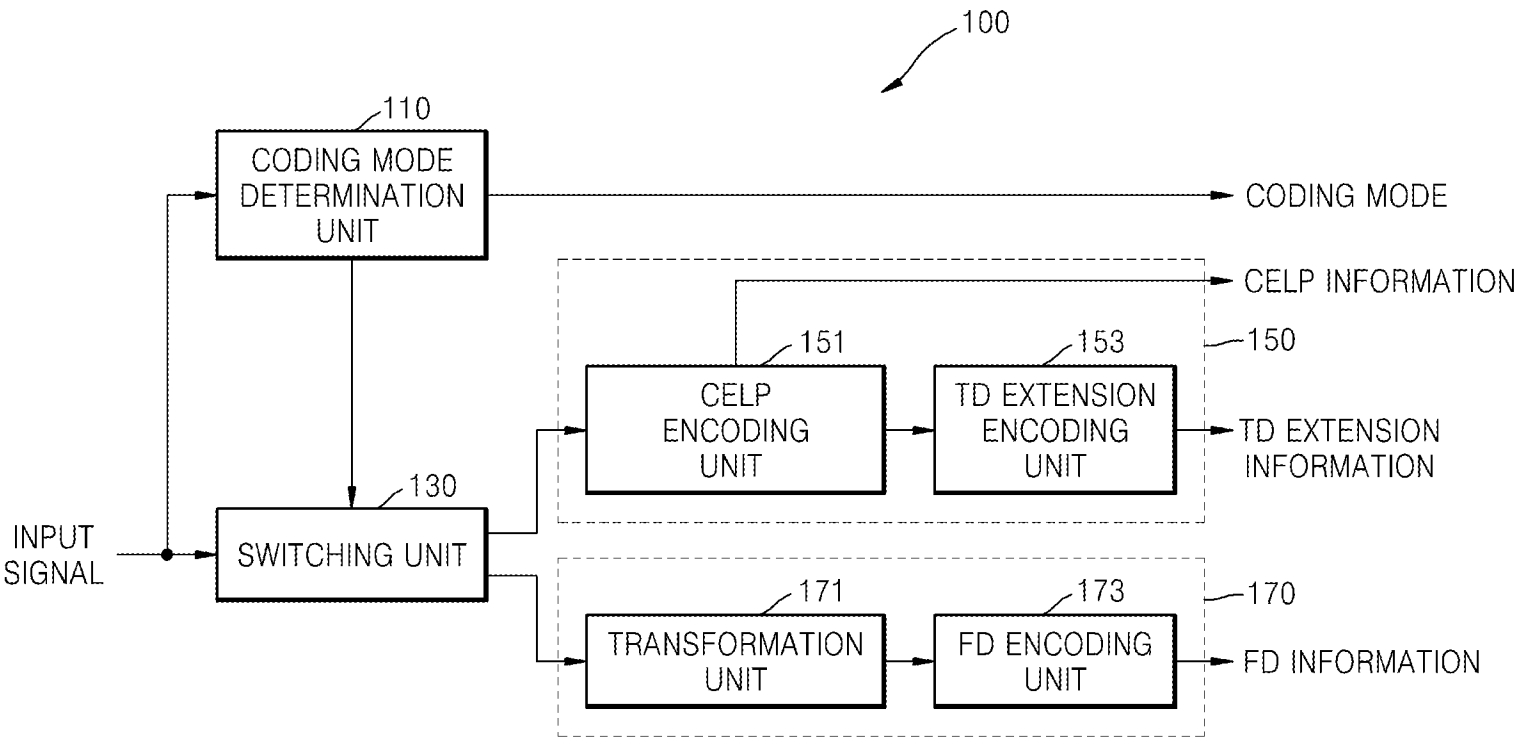
FIG. 1 shows a block diagram of an audio encoding apparatus according to an exemplary embodiment.

While exemplary embodiments of the present inventive concept are susceptible to various modifications and alternative forms, specific embodiments thereof are shown by way of example in the drawings and will herein be described in detail. It should be understood, however, that there is no intent to limit exemplary embodiments to the particular forms disclosed, but conversely, exemplary embodiments are to cover all modifications, equivalents, and alternatives falling within the spirit and scope of the inventive concept. In the following description of the present inventive concept, a detailed description of known functions and configurations incorporated herein will be omitted when it may make the subject matter of the present inventive concept unclear.

It will be understood that, although the terms first, second, etc. may be used herein to describe various elements, these elements should not be limited by these terms. These terms are only used to distinguish one element from another.

The terminology used herein is for the purpose of describing particular embodiments and is not intended to limit the inventive concept. Although general terms are used as long as possible in consideration of the functions of the present inventive concept their meanings may vary according to intentions of one of ordinary skill in the art, precedents, or the appearance of new technologies. Also, in particular cases, terms can be arbitrarily selected by the applicant and, in this case, their meanings will be described in detail in the detailed description of the inventive concept. Accordingly, definitions of the terms should be understood on the basis of the entire description of the present specification.

As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Hereinafter, the present inventive concept will be described in detail by explaining embodiments of the inventive concept with reference to the attached drawings. In the drawings, like reference numerals denote like elements and the sizes or thicknesses of elements may be exaggerated for clarity of explanation.

FIG. 1 is a block diagram of an audio encoding apparatus 100 according to an exemplary embodiment. The audio encoding apparatus 100 illustrated in FIG. 1 may form a multimedia device and may be, but not limited to, a voice communication device such as a phone or a mobile phone, a broadcasting or music device such as a TV or an MP3 player, or a combined device of the voice communication device and the broadcasting or music device. Also, the audio encoding apparatus 100 may be used as a converter included in a client device or a server, or disposed between the client device and the server.

The audio encoding apparatus 100 illustrated in FIG. 1 may include a coding mode determination unit 110, a switching unit 130, a code excited linear prediction (CELP) encoding module 150, and a frequency domain (FD) encoding module 170. The CELP encoding module 150 may include a CELP encoding unit 151 and a time domain (TD) extension encoding unit 153, and the FD encoding module 170 may include a transformation unit 171 and an FD encoding unit 173. The above elements may be integrated into at least one module and may be implemented by at least one processor (not shown).

Referring to FIG. 1, the coding mode determination unit 110 may determine a coding mode of an input signal with reference to signal characteristics. According to the signal characteristics, the coding mode determination unit 110 may determine whether a current frame is in a speech mode or a music mode, and may also determine whether a coding mode efficient for the current frame is a TD mode or an FD mode. In this case, the signal characteristics may be obtained by using, but are not limited to, short-term characteristics of a frame or long term characteristics of a plurality of frames. The coding mode determination unit 110 may determine a CELP mode if the signal characteristics correspond to a speech mode or a TD mode, and may determine an FD mode if the signal characteristics correspond to a music mode or an FD mode.

According to an embodiment, the input signal of the coding mode determination unit 110 may be a signal that is down-sampled by a down sampling unit (not shown). For example, the input signal may be a signal having a sampling rate of 12.8 kHz or 16 kHz, which is obtained by re-sampling or down-sampling a signal having a sampling rate of 32 kHz or 48 kHz. Here, a signal having a sampling rate of 32 kHz is a super wide band (SWB) signal and may be referred to as a full band (FB) signal, and a signal having a sampling rate of 16 kHz may be referred to as a wide band (WB) signal.

According to another embodiment, the coding mode determination unit 110 may perform the re-sampling or down-sampling operation.

As such, the coding mode determination unit 110 may determine a coding mode of the re-sampled or down-sampled signal.

Information regarding the coding mode determined by the coding mode determination unit 110 may be provided to the switching unit 130 and may be included in a bitstream in units of frames so as to be stored or transmitted.

According to the information regarding the coding mode, which is provided from the coding mode determination unit 110, the switching unit 130 may provide the input signal to the CELP encoding module 150 or the FD encoding module 170. Here, the input signal may be a re-sampled or down-sampled signal and may be a low-frequency signal having a sampling rate of 12.8 kHz or 16 kHz. Specifically, the switching unit 130 provides the input signal to the CELP encoding module 150 if the coding mode is a CELP mode, and provides the input signal to the FD encoding module 170 if the coding mode is an FD mode.

The CELP encoding module 150 may operate if the coding mode is a CELP mode, and the CELP encoding unit 151 may perform CELP encoding on the input signal. According to an embodiment, the CELP encoding unit 151 may extract an excitation signal from the re-sampled or down-sampled signal, and may quantize the extracted excitation signal in consideration of each of a filtered adaptive code vector (i.e., an adaptive codebook contribution) and a filtered fixed code vector (i.e., a fixed or innovation codebook contribution) corresponding to pitch information. According to another embodiment, the CELP encoding unit 151 may extract linear prediction coefficients (LPCs), may quantize the extracted LPCs, may extract an excitation signal by using the quantized LPCs, and may quantize the extracted excitation signal in consideration of each of a filtered adaptive code vector (i.e., an adaptive codebook contribution) and a filtered fixed code vector (i.e., a fixed or innovation codebook contribution) corresponding to pitch information.

Meanwhile, the CELP encoding unit 151 may apply different coding modes according to the signal characteristics. The applied coding modes may include, but are not limited to, a voiced coding mode, an unvoiced coding mode, a transient coding mode, and a generic coding mode.

The low-frequency excitation signal obtained by the encoding of the CELP encoding unit 151, i.e., CELP information, may be provided to the TD extension encoding unit 153 and may be included in the bitstream so as to be stored or transmitted.

In the CELP encoding module 150, the TD extension encoding unit 153 may perform high-frequency extension encoding by folding or replicating the low-frequency excitation signal provided from the CELP encoding unit 151. High-frequency extension information obtained by the extension encoding of the TD extension encoding unit 153 may be included in the bitstream so as to be stored or transmitted. The TD extension encoding unit 153 quantizes LPCs corresponding to a high-frequency band of the input signal. In this case, the TD extension encoding unit 153 may extract LPCs of a high-frequency band of the input signal and may quantize the extracted LPCs. Also, the TD extension encoding unit 153 may generate LPCs of the high-frequency band of the input signal by using the low-frequency excitation signal of the input signal. Here, the LPCs of the high-frequency band may be used to represent envelope information of the high-frequency band.

Meanwhile, the FD encoding module 170 may operate if the coding mode is an FD mode, and the transformation unit 171 may transform the re-sampled or down-sampled signal from the time domain to the frequency domain. In this case, the transformation unit 171 may perform, but is not limited to, modified discrete cosine transformation (MDCT). In the FD encoding module 170, the FD encoding unit 173 may perform FD encoding on the re-sampled or down-sampled spectrum provided from the transformation unit 171. The FD encoding may be performed by using, but is not limited to, an algorithm applied to the Advanced Audio Codec (AAC). FD information obtained by the FD encoding of the FD encoding unit 173 may be included in the bitstream so as to be stored or transmitted. Meanwhile, if coding modes of neighboring frames are changed from a CELP mode into an FD mode, prediction data may be further included in the bitstream obtained due to the FD encoding of the FD encoding unit 173. Specifically, since, if encoding based on a CELP mode is performed on an Nth frame and encoding based on an FD mode is performed on an (N+1)th frame, the (N+1)th frame may not be decoded by using only a result of the encoding based on an FD mode, prediction data to be referred to in a decoding process needs to be additionally included.

In the audio encoding apparatus 100 illustrated in FIG. 1, two types of a bitstream may be generated according to the coding mode determined by the coding mode determination unit 110. Here, the bitstream may include a header and a payload.

Specifically, if the coding mode is a CELP mode, information regarding the coding mode may be included in the header, and CELP information and TD extension information may be included in the payload. Otherwise, if the coding mode is an FD mode, information regarding the coding mode may be included in the header, and FD information and prediction data may be included in the payload. Here, the FD information may include FD high-frequency extension information.

Meanwhile, in order to be prepared for a case when a frame error occurs, a header of each bitstream may further include information regarding a coding mode of a previous frame. For example, if a coding mode of a current frame is determined as an FD mode, the header of the bitstream may further include information regarding a coding mode of a previous frame.

The audio encoding apparatus 100 illustrated in FIG. 1 may be switched to a CELP mode or an FD mode according to signal characteristics and thus may efficiently perform adaptive encoding with respect to the signal characteristics. Meanwhile, the switching structure illustrated in FIG. 1 may be applied to a high bit rate environment.

Figure 2:
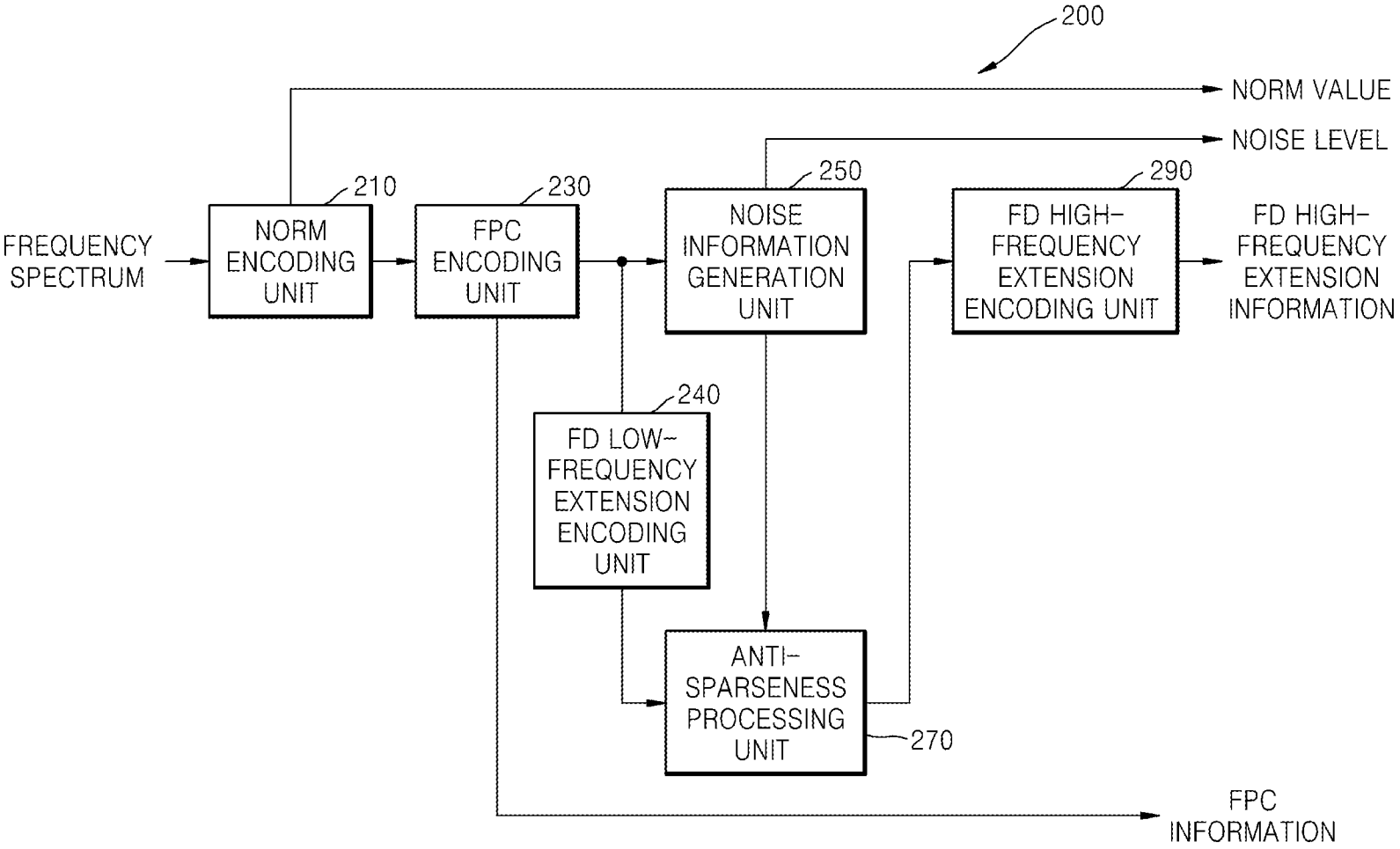
FIG. 2 shows a block diagram of an example of a frequency domain (FD) encoding unit illustrated in FIG. 1.

FIG. 2 is a block diagram of an example of the FD encoding unit 173 illustrated in FIG. 1.

Referring to FIG. 2, an FD encoding unit 200 may include a norm encoding unit 210, a factorial pulse coding (FPC) encoding unit 230, an FD low-frequency extension encoding unit 240, a noise information generation unit 250, an anti-sparseness processing unit 270, and an FD high-frequency extension encoding unit 290.

The norm encoding unit 210 estimates or calculates a norm value of each frequency band, e.g., each subband, of a frequency spectrum provided from the transformation unit 171 illustrated in FIG. 1, and quantizes the estimated or calculated norm value. Here, the norm value may refer to an average of spectral energy calculated in units of subbands, and may also be referred to as power. The norm value may be used to normalize the frequency spectrum in units of subbands. Also, with respect to a total number of bits according to a target bit rate, the norm encoding unit 210 may calculate a masking threshold value by using the norm value of each subband, and may determine the number of bits to be allocated to perform perceptual encoding on each subband by using the masking threshold value. Here, the number of bits may be determined in units of an integer or a decimal. The norm value quantized by the norm encoding unit 210 may be provided to the FPC encoding unit 230, and may be included in a bitstream so as to be stored or transmitted.

The FPC encoding unit 230 may quantize the normalized spectrum by using the number of bits allocated to each subband, and may perform FPC encoding on a result of the quantization. Due to the FPC encoding, information such as the position, amplitude, and sign of a pulse may be represented in the form of a factorial within a range of the number of allocated bits. FPC information obtained by the FPC encoding unit 230 may be included in the bitstream so as to be stored or transmitted.

The noise information generation unit 250 may generate noise information, i.e., a noise level, in units of subbands according to a result of the FPC encoding. Specifically, due to lack of bits, the frequency spectrum encoded by the FPC encoding unit 230 may have an unencoded part, i.e., a hole, in units of subbands. According to an embodiment, the noise level may be generated by using an average of levels of unencoded spectral coefficients. The noise level generated by the noise information generation unit 250 may be included in the bitstream so as to be stored or transmitted. Also, the noise level may be generated in units of frames.

The anti-sparseness processing unit 270 determines the location and the amplitude of noise to be added from a reconstructed low-frequency spectrum. The anti-sparseness processing unit 270 performs anti-sparseness processing according to the determined location and the amplitude of noise on the frequency spectrum on which noise filling has been performed by using the noise level, and provides the resultant spectrum to the FD high-frequency extension encoding unit 290. According to an embodiment, the reconstructed low-frequency spectrum may refer to a spectrum obtained by extending a low-frequency band from a result of the FPC decoding, performing noise filling, and then performing anti-sparseness processing.

The FD high-frequency extension encoding unit 290 may perform high-frequency extension encoding by using the low-frequency spectrum provided from the anti-sparseness processing unit 270. In this case, an original high-frequency spectrum may also be provided to the FD high-frequency extension encoding unit 290. According to an embodiment, the FD high-frequency extension encoding unit 290 may obtain an extended high-frequency spectrum by folding or replicating the low-frequency spectrum, and extracts energy in units of subbands with respect to the original high-frequency spectrum, adjusts the extracted energy, and quantizes the adjusted energy.

According to an embodiment, energy may be adjusted to correspond to a ratio between a first tonality calculated in units of subbands with respect to an original high-frequency spectrum, and a second tonality calculated in units of subbands with respect to a high-frequency excitation signal extended from the low-frequency spectrum. Alternatively, according to another embodiment, energy may be adjusted to correspond to a ratio between a first noisiness factor calculated by using the first tonality, and a second noisiness factor calculated by using the second tonality. Here, each of the first and second noisiness factors represents the amount of noise components in a signal. As such, if the second tonality is greater than the first tonality, or if the first noisiness factor is greater than the second noisiness factor, noise increase in a reconstruction process may be prevented by reducing the energy of a corresponding subband. In an opposite case, the energy of a corresponding subband may be increased.

Also, in order to perform vector quantization by collecting energy information, the FD high-frequency extension encoding unit 290 may simulate a method of generating an excitation signal in a predetermined frequency band, and may control energy when characteristics of the excitation signal according to a result of the simulation is different from characteristics of the original signal in the predetermined frequency band. In this case, the characteristics of the excitation signal according to the result of the simulation and the characteristics of the original signal may include at least one of a tonality and a noisiness factor, but are not limited thereto. Thus, it is possible to prevent noise from increasing when a decoding side decodes actual energy.

Meanwhile, energy may be quantized by using, but is not limited to, a multistage vector quantization (MSVQ) method. Specifically, the FD high-frequency extension encoding unit 290 may collect and perform vector quantization on the energy of odd-number subbands from among a predetermined number of subbands in a current stage, may obtain prediction errors of even-number subbands by using a result of performing vector quantization on the odd-number subbands, and may perform vector quantization on the obtained prediction errors in a next stage. Meanwhile, a case opposite to the above is also possible. That is, the FD high-frequency extension encoding unit 290 obtains a prediction error of an (n+1)th subband by using results of performing vector quantization on an nth subband and an (n+2)th subband.

Meanwhile, when vector quantization is performed on energy, a weight according to significance of each energy vector or a signal obtained by subtracting an average value from each energy vector may be calculated. In this case, the weight according to significance may be calculated to maximize the quality of a synthesized sound. If the weight according to significance is calculated, a quantization index optimized for an energy vector may be calculated by using a weighted mean square error (WMSE) to which the weight is applied.

The FD high-frequency extension encoding unit 290 may use a multimode bandwidth extension method for generating various excitation signals according to characteristics of a high-frequency signal. The multimode bandwidth extension method may provide, for example, a transient mode, a normal mode, a harmonic mode, or a noise mode according to characteristics of a high-frequency signal. Since the FD high-frequency extension encoding unit 290 operates with respect to a stationary frame, an excitation signal of each frame may be generated by using a normal mode, a harmonic mode, or a noise mode according to characteristics of a high-frequency signal.

Also, the FD high-frequency extension encoding unit 290 may generate signals of different high-frequency bands according to a bit rate. That is, a high-frequency band on which the FD high-frequency extension encoding unit 290 performs extension encoding may be set differently according to a bit rate. For example, the FD high-frequency extension encoding unit 290 may perform extension encoding on a frequency band of about 6.4 to 14.4 kHz at a bit rate of 16 kbps, and may perform extension encoding on a frequency band of about 8 to 16 kHz at a bit rate greater than 16 kbps.

For this, the FD high-frequency extension encoding unit 290 may perform energy quantization by sharing the same codebook with respect to different bit rates.

Meanwhile, in the FD encoding unit 200, if a stationary frame is input, the norm encoding unit 210, the FPC encoding unit 230, the noise information generation unit 250, the anti-sparseness processing unit 270, and the FD extension encoding unit 290 may operate. In particular, the anti-sparseness processing unit 270 may operate with respect to a normal mode of a stationary frame. Meanwhile, if a non-stationary frame, i.e., a transient frame, is input, the noise information generation unit 250, the anti-sparseness processing unit 270, and the FD extension encoding unit 290 do not operate. In this case, compared to a case when a stationary frame is input, the FPC encoding unit 230 may increase an upper frequency band allocated to perform FPC, i.e., a core frequency band Fcore, to a higher frequency band Fend.

Figure 3:
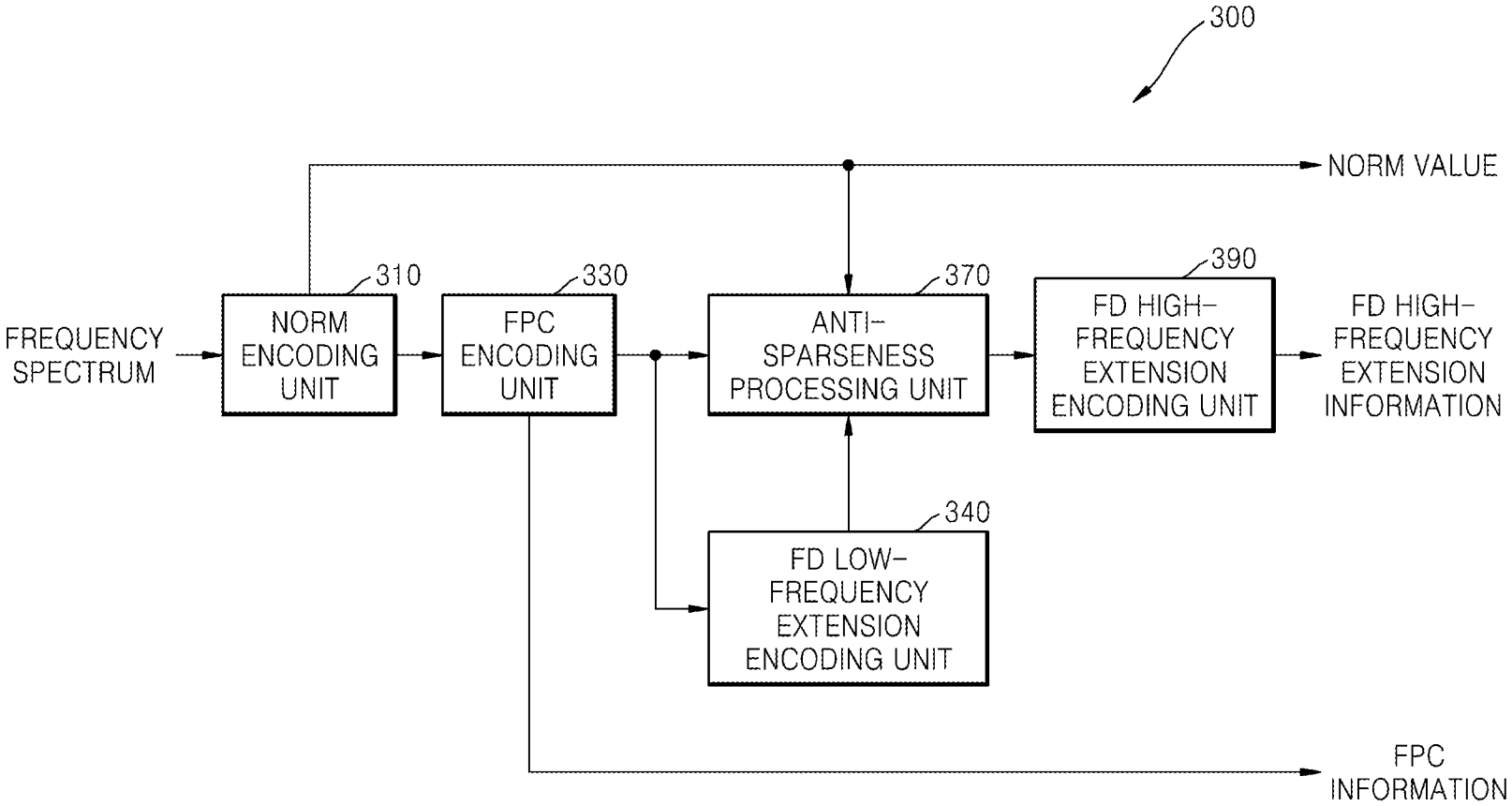
FIG. 3 shows a block diagram of another example of the FD encoding unit illustrated in FIG. 1.

FIG. 3 is a block diagram of another example of the FD encoding unit illustrated in FIG. 1.

Referring to FIG. 3, the FD encoding unit 300 may include a norm encoding unit 310, an FPC encoding unit 330, an FD low-frequency extension encoding unit 340, an anti-sparseness processing unit 370, and an FD high-frequency extension encoding unit 390. Here, operations of the norm encoding unit 310, the FPC encoding unit 330, and the FD high-frequency extension encoding unit 390 are substantially the same as those of the norm encoding unit 210, the FPC encoding unit 230, and the FD high-frequency extension encoding unit 290 illustrated in FIG. 2, and thus detailed descriptions thereof are not provided here.

A difference from FIG. 2 is that the anti-sparseness processing unit 370 does not use an additional noise level and uses a norm value obtained in units of subbands from the norm encoding unit 310. That is, the anti-sparseness processing unit 370 determines the location and the amplitude of noise to be added in a reconstructed low-frequency spectrum, performs anti-sparseness processing according to the determined location and the amplitude of noise on the frequency spectrum on which noise filling has been performed by using the norm value, and provides the resultant spectrum to the FD high-frequency extension encoding unit 390. Specifically, with respect to a subband including a part that is inversely quantized to 0, a noise component may be generated and the energy of the noise component may be adjusted by using a ratio between the energy of the noise component and an inversely quantized norm value, i.e., spectral energy. According to another embodiment, with respect to a subband including a part that is inversely quantized to 0, a noise component may be generated and adjusted in such a way that an average energy of the noise component is 1.

Figure 4:
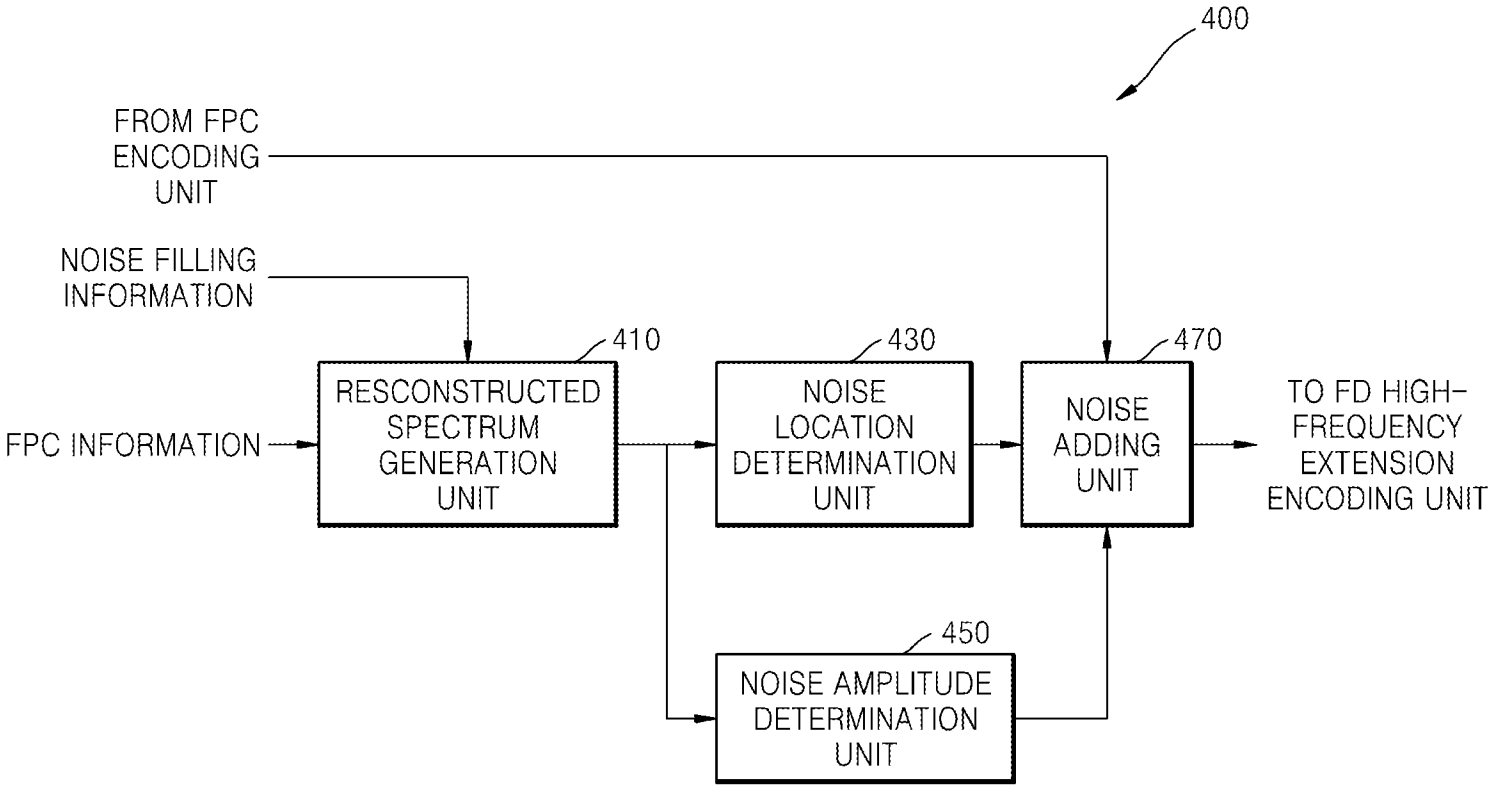
FIG. 4 shows a block diagram of an anti-sparseness processing unit according to according to an exemplary embodiment.

FIG. 4 is a block diagram of an anti-sparseness processing unit according to an exemplary embodiment.

Referring to FIG. 4, the anti-sparseness processing unit 400 may include a reconstructed spectrum generation unit 410, a noise location determination unit 430, a noise amplitude determination unit 440, and a noise adding unit 450.

The reconstructed spectrum generation unit 410 generates a reconstructed low-frequency spectrum by using FPC information provided from the FPC encoding unit 230 or 330 illustrated in FIG. 2 or 3 and noise filling information such as a noise level or a norm value. In this case, if Fcore and Ffpc are different, the reconstructed low-frequency spectrum may be generated by additionally performing FD low-frequency extension encoding.

The noise location determination unit 430 may determine a spectrum restored to 0 in the reconstructed low-frequency spectrum as the location of noise. According to another embodiment, the location of noise to be added may be determined among spectrums restored to 0, in consideration of the amplitude of a neighboring spectrum. For example, if the amplitude of a neighboring spectrum of a spectrum restored to 0 is equal to or greater than a predetermined value, the spectrum restored to 0 may be determined as the location of noise. Here, the predetermined value may be previously set as an optimal value that is set through simulation or experiment to minimize information loss of a neighboring spectrum of a spectrum restored to 0.

The noise amplitude determination unit 440 may determine the amplitude of noise to be added to the determined location of noise. According to an embodiment, the amplitude of noise may be determined based on a noise level. For example, the amplitude of noise may be determined by changing a noise level by a predetermined ratio. Specifically, the amplitude of noise may be determined as, but is not limited to, (0.5×noise level). According to another embodiment, the amplitude of noise may be determined by adaptively changing a noise level in consideration of the amplitude of a neighboring spectrum at the determined location of noise. If the amplitude of a neighboring spectrum is smaller than the amplitude of noise to be added, the amplitude of the noise may be changed to be less than the amplitude of the neighboring spectrum.

The noise adding unit 450 may add noise based on the determined location and the amplitude of noise by using random noise. According to an embodiment, a random sign may be applied. The amplitude of noise may have a fixed value and the sign of the value may be changed according to whether a random signal generated by using a random seed has an odd or even value. For example, a + sign may be given if the random signal has an even value, and a − sign may be given if the random signal has an odd value. The low-frequency spectrum to which noise is added by the noise adding unit 470 is provided to the FD high-frequency extension encoding unit 290 illustrated in FIG. 2. The low-frequency spectrum which is provided to the FD high-frequency extension encoding unit 290 may indicate a core decoded signal which is obtained by performing a noise filling processing, a low-frequency band extension and an anti-sparseness processing, on a low-frequency spectrum obtained from an FPC decoding.

Figure 5:
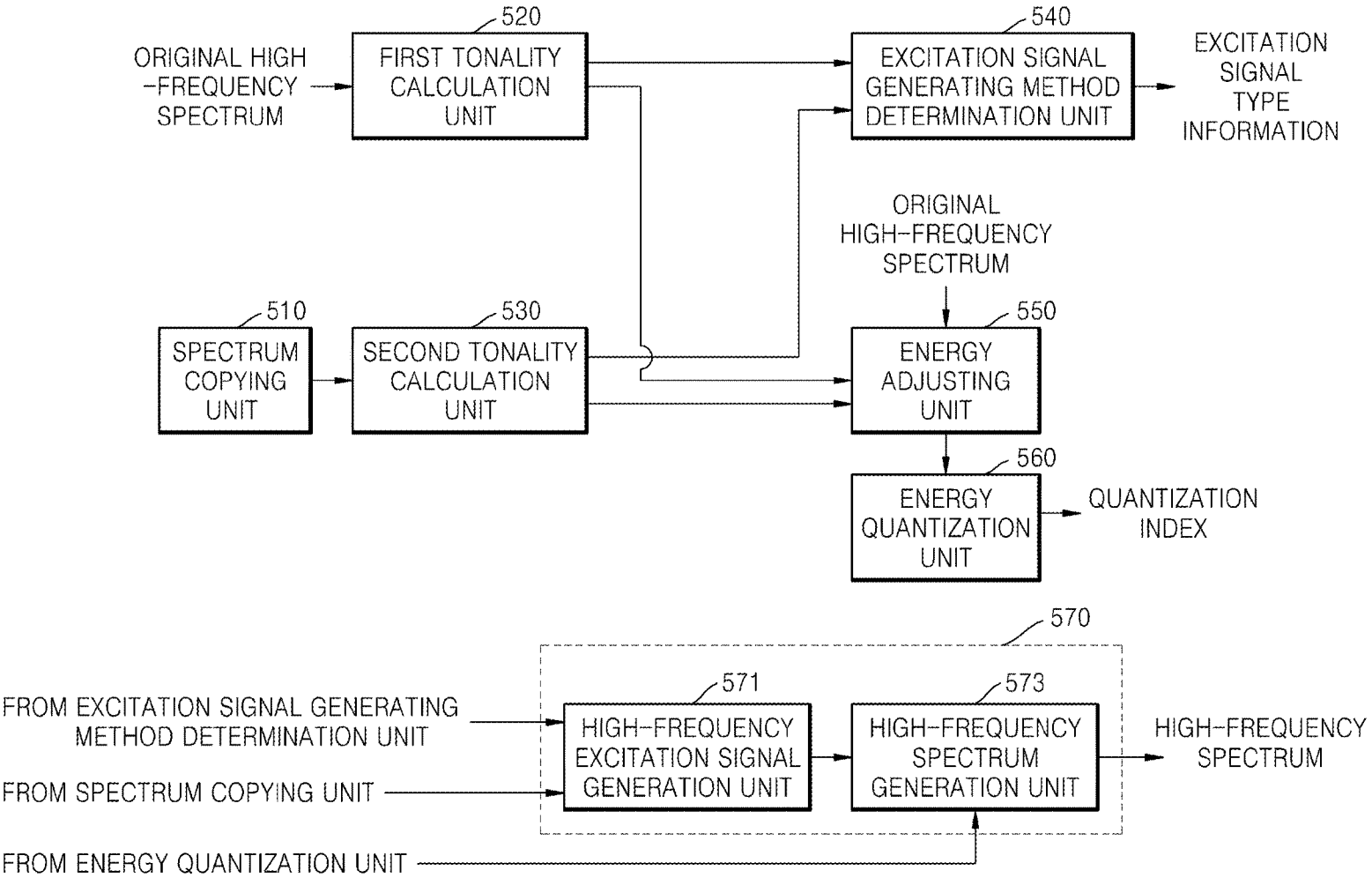
FIG. 5 shows a block diagram of an FD high-frequency extension encoding unit according to an exemplary embodiment.

FIG. 5 is a block diagram of an FD high-frequency extension encoding unit according to an exemplary embodiment.

Referring to FIG. 5, the FD high-frequency extension encoding unit 500 may include a spectrum copying unit 510, a first tonality calculation unit 520, a second tonality calculation unit 530, an excitation signal generating method determination unit 540, an energy adjusting unit 550, and an energy quantization unit 560. Meanwhile, if an encoding apparatus requires a reconstructed high-frequency spectrum, a reconstructed high-frequency spectrum generating module 570 may be further included. The reconstructed high-frequency spectrum generating module 570 may include a high-frequency excitation signal generation unit 571 and a high-frequency spectrum generation unit 573. In particular, if the FD encoding unit 173 illustrated in FIG. 1 uses a transformation method, e.g., MDCT, capable of allowing restoration by performing an overlap-add method on a previous frame, and if a CELP mode and an FD mode are switched between frames, the reconstructed high-frequency spectrum generating module 570 needs to be added.

The spectrum copying unit 510 may fold or replicate the low-frequency spectrum provided from the anti-sparseness processing unit 270 or 370 illustrated in FIG. 2 or 3 so as to extend the low-frequency spectrum to a high-frequency band. For example, a high-frequency band of 8 to 16 kHz may be extended by using a low-frequency spectrum of 0 to 8 kHz. According to an embodiment, instead of the low-frequency spectrum provided from the anti-sparseness processing unit 270 or 370, an original low-frequency spectrum may be extended to a high-frequency band by folding or replicating the original low-frequency spectrum.

The first tonality calculation unit 520 calculates a first tonality in units of predetermined subbands with respect to an original high-frequency spectrum.

The second tonality calculation unit 530 calculates a second tonality in units of subbands with respect to the high-frequency spectrum extended by using the low-frequency spectrum by the spectrum copying unit 510.

Each of the first and second tonalities may be calculated by using spectral flatness based on a ratio between an average amplitude and a maximum amplitude of a spectrum of a subband. Specifically, the spectral flatness may be calculated by using correlations between a geometrical average and an arithmetical average of a frequency spectrum. That is, the first and second tonalities represent whether a spectrum has peaky or flat characteristics. The first and second tonality calculation units 520 and 530 may operate by using the same method in units of the same subband.

The excitation signal generating method determination unit 540 may determine a method of generating a high-frequency excitation signal by comparing the first and second tonalities. The method of generating a high-frequency excitation signal may be determined by using the high-frequency spectrum generated by modifying the low-frequency spectrum and an adaptive weight of random noise. In this case, a value corresponding to the adaptive weight may be excitation signal type information, and the excitation signal type information may be included in a bitstream so as to be stored or transmitted. According to an embodiment, the excitation signal type information may be formed in 2 bits. Here, the 2 bits may be formed in four steps with reference to a weight to be applied to random noise. The excitation signal type information may be transmitted once for each frame. Also, a plurality of subbands may form one group and the excitation signal type information may be defined in each group and may be transmitted for each group.

According to an embodiment, the excitation signal generating method determination unit 540 may determine the method of generating a high-frequency excitation signal in consideration of only characteristics of an original high-frequency signal. Specifically, the method of generating the excitation signal may be determined by identifying a region including an average of first tonalities calculated in units of subbands and according to a region corresponding to the value of a first tonality with reference to the number of pieces of the excitation signal type information. According to the above method, if the value of a tonality is high, i.e., if a spectrum has peaky characteristics, a weight to be applied to random noise may be set to be small.

According to another embodiment, the excitation signal generating method determination unit 540 may determine the method of generating the high-frequency excitation signal in consideration of both characteristics of the original high-frequency signal and characteristics of a high-frequency signal to be generated by performing band extension. For example, if the characteristics of the original high-frequency signal and the characteristics of the high-frequency signal to be generated by performing band extension are similar, a weight of random noise may be set to be small. Otherwise, if the characteristics of the original high-frequency signal and the characteristics of the high-frequency signal to be generated by performing band extension are different, a weight of random noise may be set to be large. Meanwhile, it may be set with reference to an average of differences between the first and second tonalities for each subband. If the average of differences between the first and second tonalities for each subband is large, a weight of random noise may be set to be large. Otherwise, if the average of differences between the first and second tonalities for each subband is small, a weight of random noise may be set to be small. Meanwhile, if the excitation signal type information is transmitted for each group, the average of differences between the first and second tonalities for each subband is calculated by using an average of subbands included in one group.

The energy adjusting unit 550 may calculate energy in units of subbands with respect to the original high-frequency spectrum, and adjusts the energy by using the first and second tonalities. For example, if the first tonality is large and the second tonality is small, i.e., if the original high-frequency spectrum is peaky and an output spectrum of the anti-sparseness processing unit 270 or 370 is flat, the energy is adjusted based on a ratio of the first and second tonalities.

The energy quantization unit 560 may perform vector quantization on the adjusted energy and may include in the bitstream a quantization index generated due to the vector quantization so as to store or transmit the bitstream.

Figure 11:
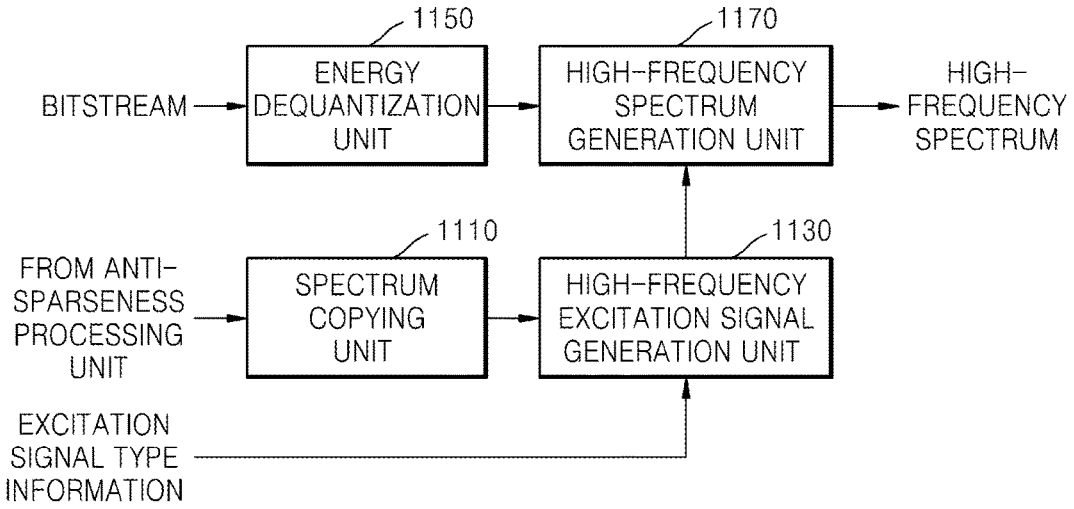
FIG. 11 shows a block diagram of an example of an FD high-frequency extension decoding unit illustrated in FIG. 10.

Meanwhile, in the reconstructed high-frequency spectrum generating module 570, operations of the high-frequency excitation signal generation unit 571 and the high-frequency spectrum generation unit 573 are substantially the same as those of a high-frequency excitation signal generation unit 1130 and a high-frequency spectrum generation unit 1170 illustrated in FIG. 11, and thus detailed descriptions thereof will not be provided here.

Figure 6A:
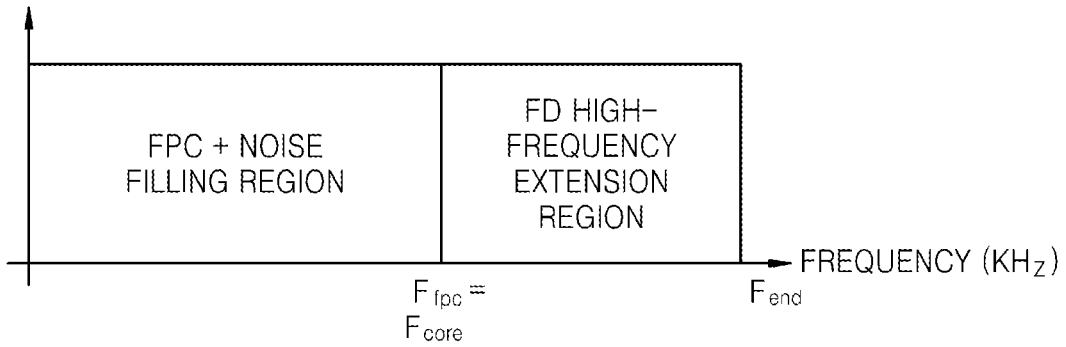
FIGS. 6A and 6B are graphs showing a region where extension encoding is performed by an FD encoding module illustrated in FIG. 1.
Figure 6B:
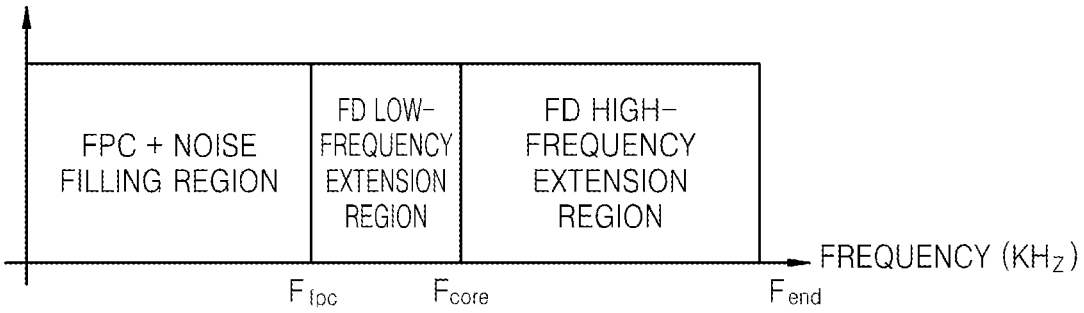

FIGS. 6A and 6B are graphs showing a region where extension encoding is performed by the FD encoding module 170 illustrated in FIG. 1. FIG. 6A shows a case when an upper frequency band Ffpc on which FPC has been actually performed is the same as a low-frequency band allocated to perform FPC, i.e., a core frequency band Fcore. In this case, FPC and noise filling are performed on a low-frequency band to Fcore, and extension encoding is performed by using a signal of the low-frequency band on a high-frequency band corresponding to Fend-Fcore. Here, Fend may be a maximum frequency that is obtainable due to high-frequency extension.

Meanwhile, FIG. 6B shows a case when an upper frequency band Ffpc on which FPC has been actually performed is smaller than a core frequency band Fcore. FPC and noise filling are performed on a low-frequency band corresponding to Ffpc, extension encoding is performed on a low-frequency band corresponding to Fcore-Ffpc by using a signal of the low-frequency band on which FPC and noise filling have been performed, and extension encoding is performed on a high-frequency band corresponding to Fend-Fcore by using a signal of the whole low-frequency band. Likewise, Fend may be a maximum frequency that is obtainable due to high-frequency extension.

Here, Fcore and Fend may be variably set according to a bit rate. For example, according to a bit rate, Fcore may be, but is not limited to, 6.4 kHz, 8 kHz, or 9.6 kHz, and Fend may be extended to, but is not limited to, 14 kHz, 14.4 kHz, or 16 kHz. Meanwhile, the upper frequency band Ffpc on which FPC has been actually performed corresponds to a frequency band on which noise filling is performed.

Figure 7:
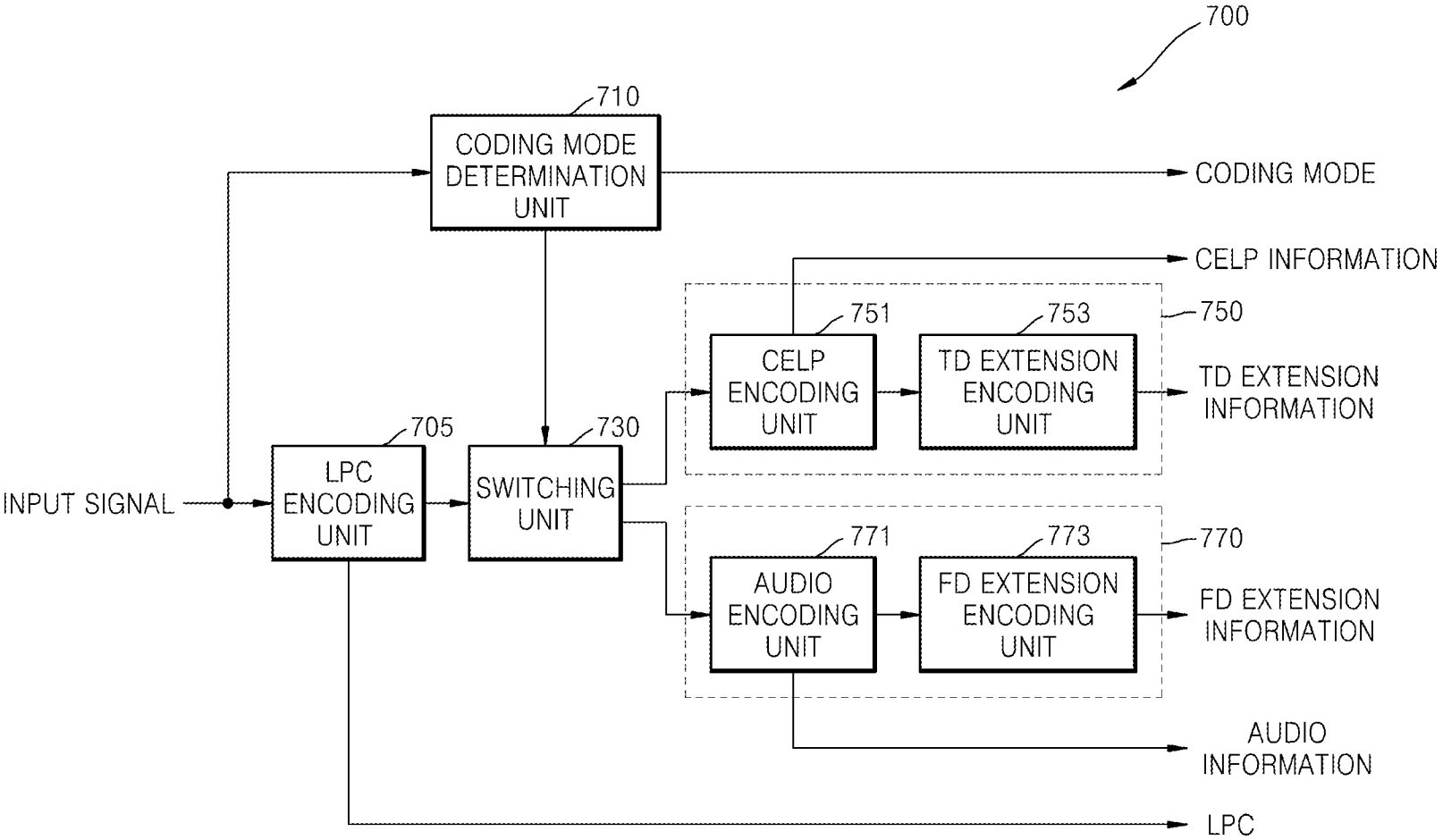
FIG. 7 shows a block diagram of an audio encoding apparatus according to another exemplary embodiment.

FIG. 7 is a block diagram of an audio encoding apparatus according to another exemplary embodiment.

The audio encoding apparatus 700 illustrated in FIG. 7 may include a coding mode determination unit 710, an LPC encoding unit 705, a switching unit 730, a CELP encoding module 750, and an audio encoding module 770. The CELP encoding module 750 may include a CELP encoding unit 751 and a TD extension encoding unit 753, and the audio encoding module 770 may include an audio encoding unit 771 and an FD extension encoding unit 773. The above elements may be integrated into at least one module and may be driven by at least one processor (not shown).

Referring to FIG. 7, the LPC encoding unit 705 may extract LPCs from an input signal and may quantize the extracted LPCs. For example, the LPC encoding unit 705 may quantize the LPCs by using, but is not limited to, a trellis coded quantization (TCQ) method, a multistage vector quantization (MSVQ) method, or a lattice vector quantization (LVQ) method. The LPCs quantized by the LPC encoding unit 705 may be included in a bitstream so as to be stored or transmitted.

Specifically, the LPC encoding unit 705 may extract LPCs from a signal having a sampling rate of 12.8 kHz or 16 kHz, which is obtained by re-sampling or down-sampling a signal having a sampling rate of 32 kHz or 48 kHz.

Like the coding mode determination unit 110 illustrated in FIG. 1, the coding mode determination unit 710 may determine a coding mode of the input signal with reference to signal characteristics. According to the signal characteristics, the coding mode determination unit 710 may determine whether a current frame is in a speech mode or a music mode, and may also determine whether a coding mode efficient for the current frame is a TD mode or an FD mode.

The input signal of the coding mode determination unit 710 may be a signal that is down-sampled by a down sampling unit (not shown). For example, the input signal may be a signal having a sampling rate of 12.8 kHz or 16 kHz, which is obtained by re-sampling or down-sampling a signal having a sampling rate of 32 kHz or 48 kHz. Here, a signal having a sampling rate of 32 kHz is an SWB signal and may be referred to as an FB signal, and a signal having a sampling rate of 16 kHz may be referred to as a WB signal.

According to another embodiment, the coding mode determination unit 710 may perform the re-sampling or down-sampling operation.

As such, the coding mode determination unit 710 may determine a coding mode of the re-sampled or down-sampled signal.

Information regarding the coding mode determined by the coding mode determination unit 710 may be provided to the switching unit 730 and may be included in a bitstream in units of frames so as to be stored or transmitted.

According to the information regarding the coding mode, which is provided from the coding mode determination unit 710, the switching unit 730 may provide the LPCs of a low-frequency band provided from the LPC encoding unit 705 to the CELP encoding module 750 or the audio encoding module 770. Specifically, the switching unit 730 provides the LPCs of the low-frequency band to the CELP encoding module 750 if the coding mode is a CELP mode, and provides the LPCs of the low-frequency band to the audio encoding module 770 if the coding mode is an audio mode.

The CELP encoding module 750 may operate if the coding mode is a CELP mode, and the CELP encoding unit 751 may perform CELP encoding on an excitation signal obtained by using the LPCs of the low-frequency band. According to an embodiment, the CELP encoding unit 751 may quantize the extracted excitation signal in consideration of each of a filtered adaptive code vector (i.e., an adaptive codebook contribution) and a filtered fixed code vector (i.e., a fixed or innovation codebook contribution) corresponding to pitch information. Here, the excitation signal may be generated by the LPC encoding unit 705 and may be provided to the CELP encoding unit 751, or may be generated by the CELP encoding unit 751.

Meanwhile, the CELP encoding unit 751 may apply different coding modes according to the signal characteristics. The applied coding modes may include, but are not limited to, a voiced coding mode, an unvoiced coding mode, a transient coding mode, and a generic coding mode.

The low-frequency excitation signal obtained due to the encoding of the CELP encoding unit 751, i.e., CELP information, may be provided to the TD extension encoding unit 753 and may be included in the bitstream.

In the CELP encoding module 750, the TD extension encoding unit 753 may perform high-frequency extension encoding by folding or replicating the low-frequency excitation signal provided from the CELP encoding unit 751. High-frequency extension information obtained due to the extension encoding of the TD extension encoding unit 753 may be included in the bitstream.

Meanwhile, the audio encoding module 770 may operate if the coding mode is an audio mode, and the audio encoding unit 771 may perform audio encoding by transforming to the frequency domain the excitation signal obtained by using the LPCs of the low-frequency band. According to an embodiment, the audio encoding unit 771 may use a transformation method, e.g., discrete cosine transformation (DCT), capable of preventing an overlapping region between frames. Also, the audio encoding unit 771 may perform LVQ and FPC encoding on the excitation signal transformed to the frequency domain. Additionally, if extra bits are available, when the audio encoding unit 771 quantizes the excitation signal, TD information such as a filtered adaptive code vector (i.e., an adaptive codebook contribution) and a filtered fixed code vector (i.e., a fixed or innovation codebook contribution) may be further considered.

In the audio encoding module 770, the FD extension encoding unit 773 may perform high-frequency extension encoding by using the low-frequency excitation signal provided from the audio encoding unit 771. Operation of the FD extension encoding unit 773 is similar to that of the FD high-frequency extension encoding unit 290 or 390 illustrated in FIG. 2 or 3 except for their input signals, and thus detailed descriptions thereof are not provided here.

In the audio encoding apparatus 700 illustrated in FIG. 7, two types of a bitstream may be generated according to the coding mode determined by the coding mode determination unit 710. Here, the bitstream may include a header and a payload.

Specifically, if the coding mode is a CELP mode, information regarding the coding mode may be included in the header, and CELP information and TD high-frequency extension information may be included in the payload. Otherwise, if the coding mode is an audio mode, information regarding the coding mode may be included in the header, and information regarding audio encoding, i.e., audio information and FD high-frequency extension information may be included in the payload.

The audio encoding apparatus 700 illustrated in FIG. 7 may be switched to a CELP mode or an audio mode according to signal characteristics and thus may efficiently perform adaptive encoding with respect to the signal characteristics. Meanwhile, the switching structure illustrated in FIG. 1 may be applied to a low bit rate environment.

Figure 8:
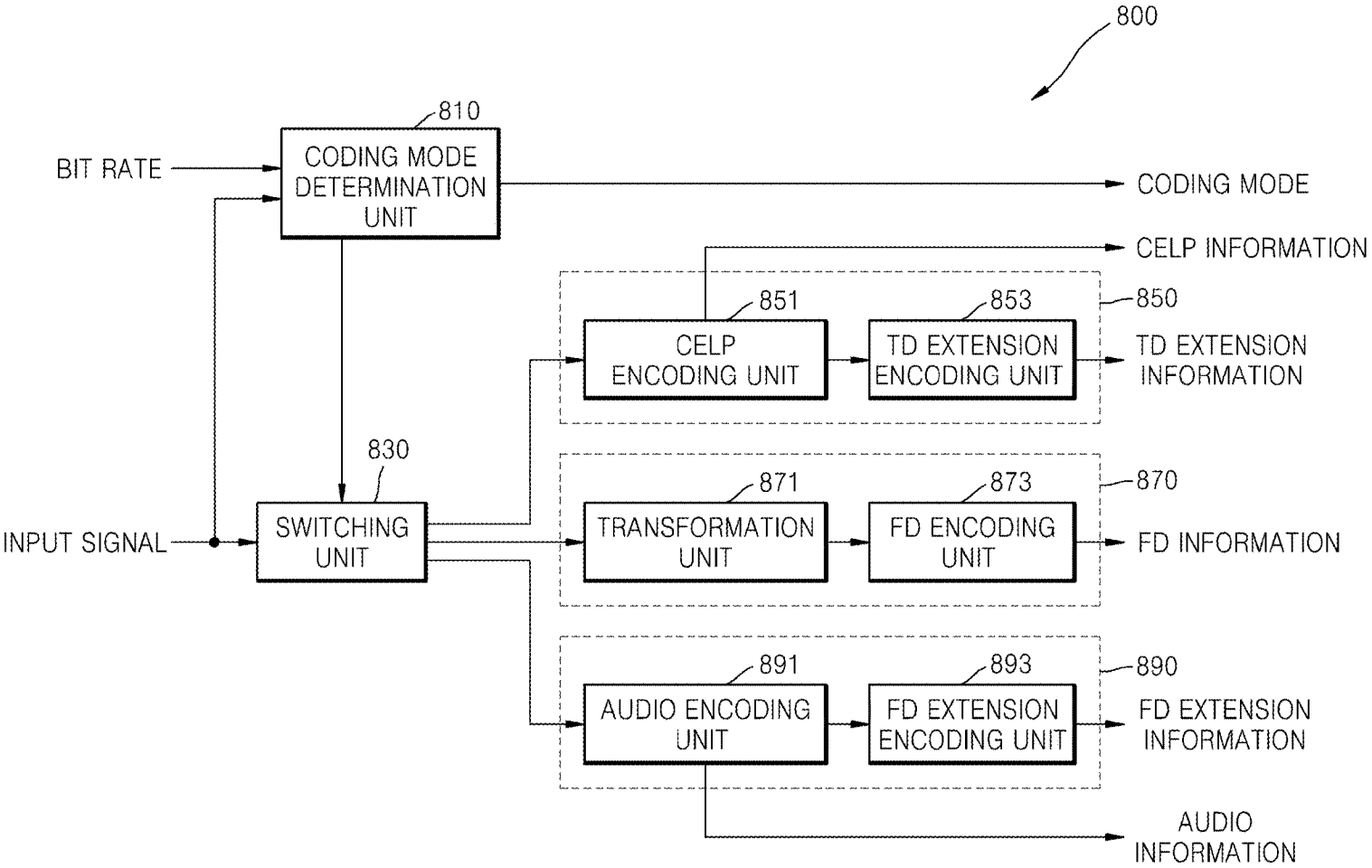
FIG. 8 shows a block diagram of an audio encoding apparatus according to another exemplary embodiment.

FIG. 8 is a block diagram of an audio encoding apparatus according to another exemplary embodiment.

The audio encoding apparatus 800 illustrated in FIG. 8 may include a coding mode determination unit 810, a switching unit 830, a CELP encoding module 850, an FD encoding module 870, and an audio encoding module 890. The CELP encoding module 850 may include a CELP encoding unit 851 and a TD extension encoding unit 853, the FD encoding module 870 may include a transformation unit 871 and an FD encoding unit 873, and the audio encoding module 890 may include an audio encoding unit 891 and an FD extension encoding unit 893. The above elements may be integrated into at least one module and may be driven by at least one processor (not shown).

Referring to FIG. 8, the coding mode determination unit 810 may determine a coding mode of an input signal with reference to signal characteristics and a bit rate. According to the signal characteristics, the coding mode determination unit 810 may determine a CELP mode or another mode based on whether a current frame is in a speech mode or a music mode, and whether a coding mode efficient for the current frame is a TD mode or an FD mode. A CELP mode is determined if the current frame is in a speech mode, an FD mode is determined if the current frame is in a music mode and has a high bit rate, and an audio mode is determined if the current frame is in a music mode and has a low bit rate.

According to information regarding the coding mode, which is provided from the coding mode determination unit 810, the switching unit 830 may provide the input signal to the CELP encoding module 850, the FD encoding module 870, or the audio encoding module 890.

Meanwhile, the audio encoding apparatus 800 illustrated in FIG. 8 is similar to a combination of the audio encoding apparatuses 100 and 700 illustrated in FIGS. 1 and 7 except that the CELP encoding unit 851 extracts LPCs from the input signal and that the audio encoding unit 891 also extracts LPCs from the input signal.

The audio encoding apparatus 800 illustrated in FIG. 8 may be switched to operate in a CELP mode, an FD mode, or an audio mode according to signal characteristics, and thus may efficiently perform adaptive encoding with respect to the signal characteristics. Meanwhile, the switching structure illustrated in FIG. 8 may be applied regardless of a bit rate.

Figure 9:
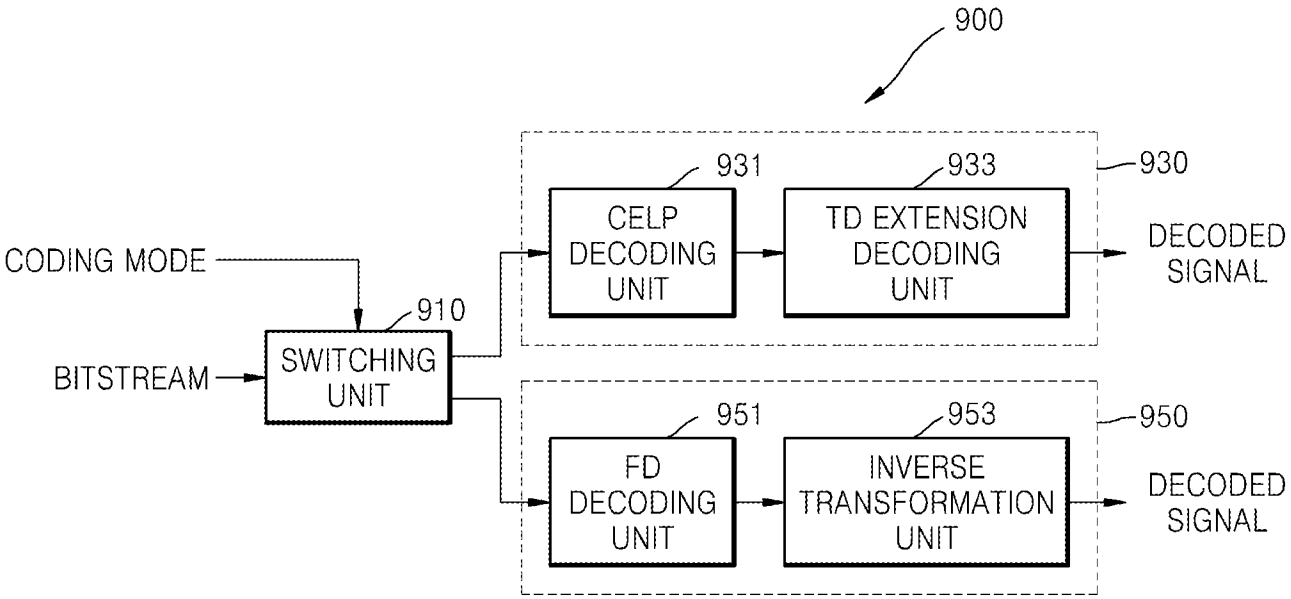
FIG. 9 shows a block diagram of an audio decoding apparatus according to an exemplary embodiment.

FIG. 9 is a block diagram of an audio decoding apparatus 900 according to an exemplary embodiment. The audio decoding apparatus 900 illustrated in FIG. 9 may form a multimedia device solely or together with the audio encoding apparatus 100 illustrated in FIG. 1, and may be, but is not limited to, a voice communication device such as a phone or a mobile phone, a broadcasting or music device such as a TV or an MP3 player, or a combined device of the voice communication device and the broadcasting or music device. Also, the audio decoding apparatus 900 may be a converter included in a client device or a server, or disposed between the client device and the server.

The audio decoding apparatus 900 illustrated in FIG. 9 may include a switching unit 910, a CELP decoding module 930, and an FD decoding module 950. The CELP decoding module 930 may include a CELP decoding unit 931 and a TD extension decoding unit 933, and the FD decoding module 950 may include an FD decoding unit 951 and an inverse transformation unit 953. The above elements may be integrated into at least one module and may be driven by at least one processor (not shown).

Referring to FIG. 9, the switching unit 910 may provide a bitstream to the CELP decoding module 930 or the FD decoding module 950 with reference to information regarding a coding mode, which is included in the bitstream. Specifically, the bitstream is provided to the CELP decoding module 930 if the coding mode is a CELP mode, and is provided to the FD decoding module 950 if the coding mode is an FD mode.

In the CELP decoding module 930, the CELP decoding unit 931 decodes LPCs included in the bitstream, decodes a filtered adaptive code vector and a filtered fixed code vector, and generates a reconstructed low-frequency signal by combining results of the decoding.

The TD extension decoding unit 933 generates a reconstructed high-frequency signal by performing high-frequency extension decoding by using at least one of a result of the CELP decoding and a low-frequency excitation signal. In this case, the low-frequency excitation signal may be included in the bitstream. Also, the TD extension decoding unit 933 may use LPC information of a low-frequency band, which is included in the bitstream, in order to generate the reconstructed high-frequency signal.

Meanwhile, the TD extension decoding unit 933 may generate a reconstructed SWB signal by combining the reconstructed high-frequency signal with the reconstructed low-frequency signal from the CELP decoding unit 931. In this case, in order to generate the reconstructed SWB signal, the TD extension decoding unit 933 may transform the reconstructed low-frequency signal and the reconstructed high-frequency signal to have the same sampling rate.

In the FD decoding module 950, the FD decoding unit 951 performs FD decoding on an FD-encoded frame. The FD decoding unit 951 may generate a frequency spectrum by decoding the bitstream. Also, the FD decoding unit 951 may perform decoding with reference to information regarding a coding mode of a previous frame, which is included in the bitstream. That is, the FD decoding unit 951 may perform FD decoding on an FD-encoded frame with reference to information regarding a coding mode of a previous frame, which is included in the bitstream.

The inverse transformation unit 953 inversely transforms a result of the FD decoding to a time domain. The inverse transformation unit 953 generates a reconstructed signal by performing inverse transformation on the FD-decoded frequency spectrum. For example, the inverse transformation unit 953 may perform, but is not limited to, inverse MDCT (IMDCT).

As such, the audio decoding apparatus 900 may decode a bitstream with reference to a coding mode in units of frames of the bitstream.

Figure 10:
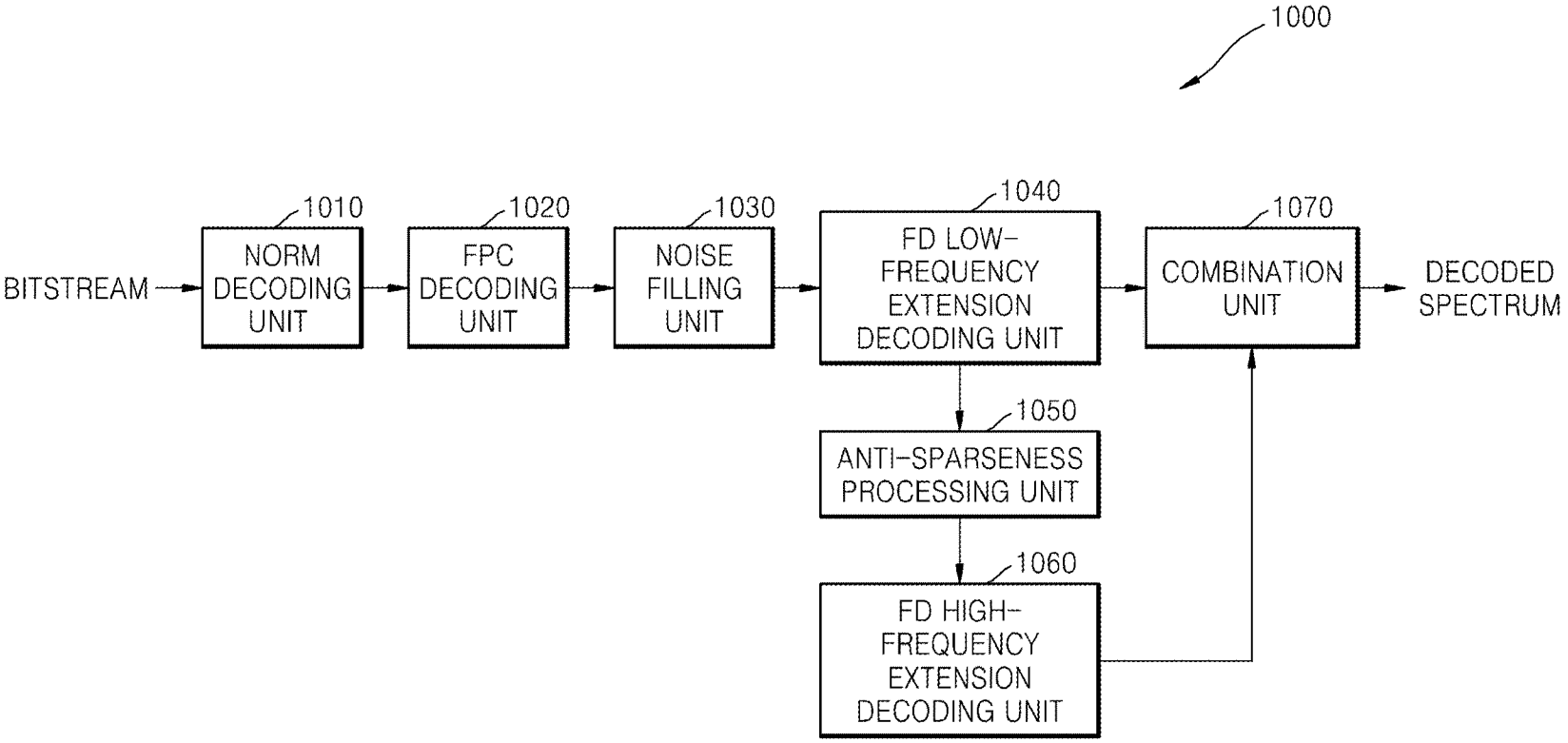
FIG. 10 shows a block diagram of an example of an FD decoding unit illustrated in FIG. 9.

FIG. 10 is a block diagram of an example of the FD decoding unit illustrated in FIG. 9.

An FD decoding unit 1000 illustrated in FIG. 10 may include a norm decoding unit 1010, an FPC decoding unit 1020, a noise filling unit 1030, an FD low-frequency extension decoding unit 1040, an anti-sparseness processing unit 1050, an FD high-frequency extension decoding unit 1060, and a combination unit 1070.

The norm decoding unit 1010 may calculate a restored norm value by decoding a norm value included in a bitstream.

The FPC decoding unit 1020 may determine the number of allocated bits by using the restored norm value, and may perform FPC decoding on an FPC-encoded spectrum by using the number of allocated bits. Here, the number of allocated bits may be determined by the FPC encoding unit 230 or 330 illustrated in FIG. 2 or 3.

The noise filling unit 1030 may perform noise filling by using a noise level that is additionally generated and provided by an audio encoding apparatus, or by using the restored norm value, with reference to a result of the FPC decoding performed by the FPC decoding unit 1020. That is, the noise filling unit 1030 may perform noise filling processing up to the last subband on which the FPC decoding has been performed.

The FD low-frequency extension decoding unit 1040 may operate when an upper frequency band Ffpc on which FPC decoding has been actually performed is less than a core frequency band Fcore. FPC decoding and noise filling may be performed on a low-frequency band up to Ffpc and the extension decoding may be performed on a low-frequency band corresponding to Fcore-Ffpc by using a signal of a low-frequency band on which the FPC decoding and the noise filling have been performed.

The anti-sparseness processing unit 1050 may prevent a metallic noise from being generated after performing the FD high-frequency extension decoding, by adding noise into a spectrum reconstructed to zero although the noise filling processing has been performed on the FPC decoded signal. Specifically, the anti-sparseness processing unit 1050 may determine the location and the amplitude of noise to be added from a low-frequency spectrum provided from the FD low-frequency extension decoding unit 1040, perform anti-sparseness processing on the low-frequency spectrum according to the determined location and the amplitude of noise, and provide the resultant spectrum to the FD high-frequency extension decoding unit 1060. The anti-sparseness processing unit 1050 may include the noise location determination unit 430, the noise amplitude determination unit 450, and the noise adding unit 470 illustrated in FIG. 4, except for the reconstructed spectrum generation unit 410.

According to an embodiment, when the noise filling processing is performed on a subband in which all spectrums are quantized to zero in the FPC decoding, the anti-sparseness processing may be performed by adding noise into a subband on which the noise filling processing is not performed and including a spectrum reconstructed to zero. According to another embodiment, the anti-sparseness processing may be performed by adding noise into a subband on which the FD low-frequency extension decoding is performed and including a spectrum reconstructed to zero.

The FD high-frequency extension decoding unit 1060 may perform high-frequency extension decoding on the low-frequency spectrum noise-added by the anti-sparseness processing unit 1050. The FD high-frequency extension decoding unit 1060 may perform inverse energy quantization by sharing the same codebook with respect to different bit rates.

The combination unit 1070 may generate a reconstructed SWB spectrum by combining the low-frequency spectrum provided from the FD low-frequency extension decoding unit 1040 and the high-frequency spectrum provided from the FD high-frequency extension decoding unit 1060.

FIG. 11 is a block diagram of an example of the FD high-frequency extension decoding unit illustrated in FIG. 10.

An FD high-frequency extension encoding unit 1100 illustrated in FIG. 11 may include a spectrum copying unit 1110, a high-frequency excitation signal generation unit 1130, an inverse energy quantization unit 1150, and a high-frequency spectrum generation unit 1170.

Like the spectrum copying unit 510 illustrated in FIG. 5, the spectrum copying unit 1110 may extend a low-frequency spectrum provided from the anti-sparseness processing unit 1050 illustrated in FIG. 10, to a high-frequency band by folding or replicating the low-frequency spectrum.

The high-frequency excitation signal generation unit 1130 may generate a high-frequency excitation signal by using the extended high-frequency spectrum provided from the spectrum copying unit 1110, and excitation signal type information extracted from a bitstream.

The high-frequency excitation signal generation unit 1130 may generate a high-frequency excitation signal by applying a weight between random noise R(n) and a spectrum G(n) transformed from the extended high-frequency spectrum provided from the spectrum copying unit 1110. Here, the transformed spectrum may be obtained by calculating an average amplitude in units of newly defined subbands of the output of the spectrum copying unit 1110, and normalizing a spectrum into the average amplitude. The transformed spectrum is level-matched to random noise in units of predetermined subbands. The level matching is a process of allowing average amplitudes of the random noise and the transformed spectrum to be the same in units of subbands. According to an embodiment, the amplitude of the transformed spectrum may be set to be slightly greater than that of the random noise. The ultimately generated high-frequency excitation signal may be calculated as $E(n)=G(n)\times(1-w(n))+R(n)\times w(n)$. Here, w(n) represents a value determined according to excitation signal type information, and n represents an index of a spectrum bin. w(n) may be a constant value, and may be defined as the same value in all subbands if transmission is performed in units of subbands. Also, w(n) may be set in consideration of smoothing between neighboring subbands.

When the excitation signal type information is defined by using 2 bits of 0, 1, 2, or 3, w(n) may be allocated to have a maximum value if the excitation signal type information represents 0, and to have a minimum value if the excitation signal type information represents 3.

The inverse energy quantization unit 1150 may restore energy by inversely quantizing a quantization index included in the bitstream.

The high-frequency spectrum generation unit 1170 may reconstruct a high-frequency spectrum from the high-frequency excitation signal based on a ratio between energy of the high-frequency excitation signal and restored energy such that the energy of the high-frequency excitation signal matches the restored energy.

Meanwhile, if an original high-frequency spectrum is peaky or includes a harmonic component to have strong tonal characteristics, the high-frequency spectrum generation unit 1170 may generate the high-frequency spectrum by using an input of the spectrum copying unit 1110 instead of the low-frequency spectrum provided from the anti-sparseness processing unit 1050 illustrated in FIG. 10.

Figure 12:
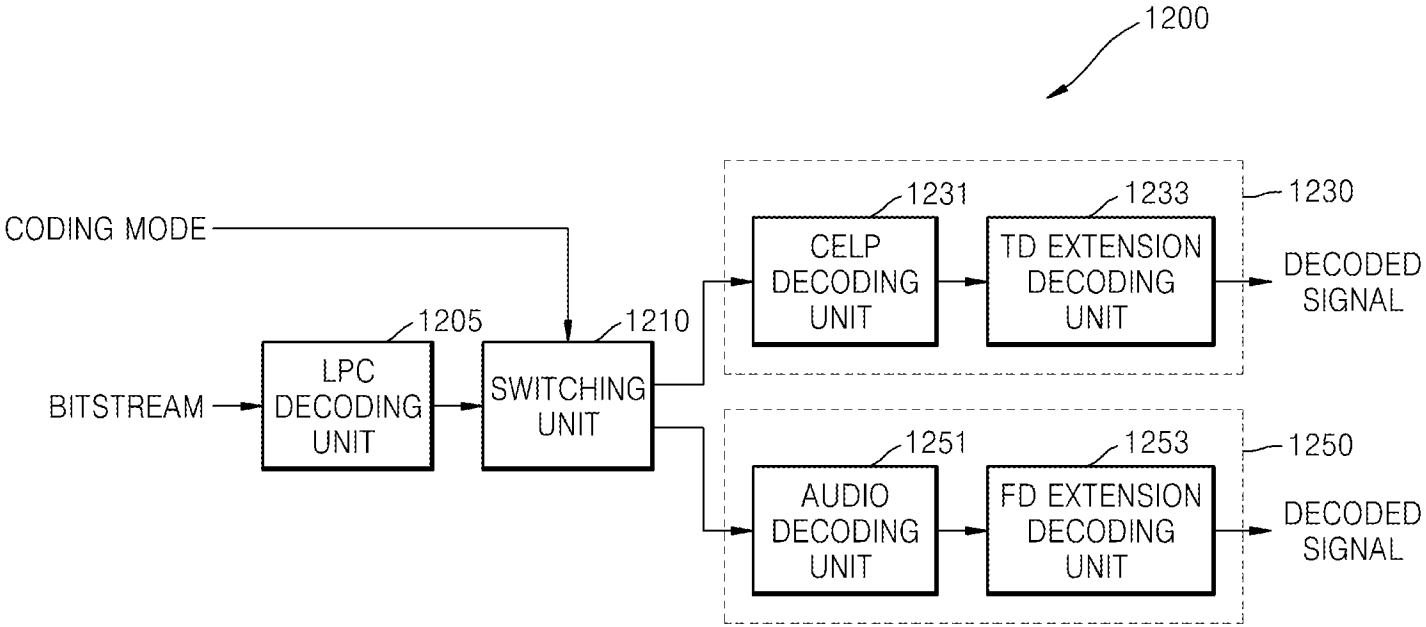
FIG. 12 shows a block diagram of an audio decoding apparatus according to another exemplary embodiment.

FIG. 12 is a block diagram of an audio decoding apparatus according to another exemplary embodiment.

The audio decoding apparatus 1200 illustrated in FIG. 12 may include an LPC decoding unit 1205, a switching unit 1210, a CELP decoding module 1230, and an audio decoding module 1250. The CELP decoding module 1230 may include a CELP decoding unit 1231 and a TD extension decoding unit 1233, and the audio decoding module 1250 may include an audio decoding unit 1251 and an FD extension decoding unit 1253. The above elements may be integrated into at least one module and may be driven by at least one processor (not shown).

Referring to FIG. 12, the LPC decoding unit 1205 performs LPC decoding on a bitstream in units of frames.

The switching unit 1210 may provide an output of the LPC decoding unit 1205 to the CELP decoding module 1230 or the audio decoding module 1250 with reference to information regarding a coding mode, which is included in the bitstream. Specifically, the output of the LPC decoding unit 1205 is provided to the CELP decoding module 1230 if the coding mode is a CELP mode, and is provided to the audio decoding module 1250 if the coding mode is an audio mode.

In the CELP decoding module 1230, the CELP decoding unit 1231 may perform CELP decoding on a CELP-encoded frame. For example, the CELP decoding unit 1231 decodes a filtered adaptive code vector and a filtered fixed code vector, and generates a reconstructed low-frequency signal by combining results of the decoding.

The TD extension decoding unit 1233 may generate a reconstructed high-frequency signal by performing high-frequency extension decoding by using at least one of a result of the CELP decoding and a low-frequency excitation signal. In this case, the low-frequency excitation signal may be included in the bitstream. Also, the TD extension decoding unit 1233 may use LPC information of a low-frequency band, which is included in the bitstream, in order to generate the reconstructed high-frequency signal.

Meanwhile, the TD extension decoding unit 1233 may generate a reconstructed SWB signal by combining the reconstructed high-frequency signal with the reconstructed low-frequency signal generated by the CELP decoding unit 1231. In this case, in order to generate the reconstructed SWB signal, the TD extension decoding unit 1233 may transform the reconstructed low-frequency signal and the reconstructed high-frequency signal to have the same sampling rate.

In the audio decoding module 1250, the audio decoding unit 1251 may perform audio decoding on an audio-encoded frame. For example, with reference to the bitstream, if a TD contribution exists, the audio decoding unit 1251 performs decoding in consideration of TD and FD contributions. Otherwise, if a TD contribution does not exist, the audio decoding unit 1251 performs decoding in consideration of an FD contribution.

Also, the audio decoding unit 1251 may generate a low-frequency excitation signal decoded by performing inverse frequency transformation on an FPC- or LVQ-quantized signal by using, for example, inverse DCT (IDCT), and may generate a reconstructed low-frequency signal by combining the generated excitation signal and an inversely quantized LPC coefficients.

The FD extension decoding unit 1253 performs extension decoding on a result of the audio decoding. For example, the FD extension decoding unit 1253 transforms the decoded low-frequency signal to have a sampling rate appropriate for high-frequency extension decoding, and performs frequency transformation such as MDCT on the transformed signal. The FD extension decoding unit 1253 may inversely quantize energy of a quantized high-frequency band, may generate a high-frequency excitation signal by using a low-frequency signal according to various modes of high-frequency extension, and may apply a gain such that energy of the generated excitation signal matches inversely quantized energy, thereby generating a reconstructed high-frequency signal. For example, various modes of high-frequency extension may be a normal mode, a transient mode, a harmonic mode, or a noise mode.

Also, the FD extension decoding unit 1253 generates an ultimate reconstructed signal by performing inverse frequency transformation such as IMDCT on the reconstructed high-frequency signal and the reconstructed low-frequency signal.

Additionally, if a transient mode is applied in bandwidth extension, the FD extension decoding unit 1253 may apply a gain calculated in the time domain such that a signal decoded after performing inverse frequency transformation matches a decoded temporal envelope, and may synthesize the gain-applied signal.

As such, the audio decoding apparatus 1200 may decode a bitstream with reference to a coding mode in units of frames of the bitstream.

Figure 13:
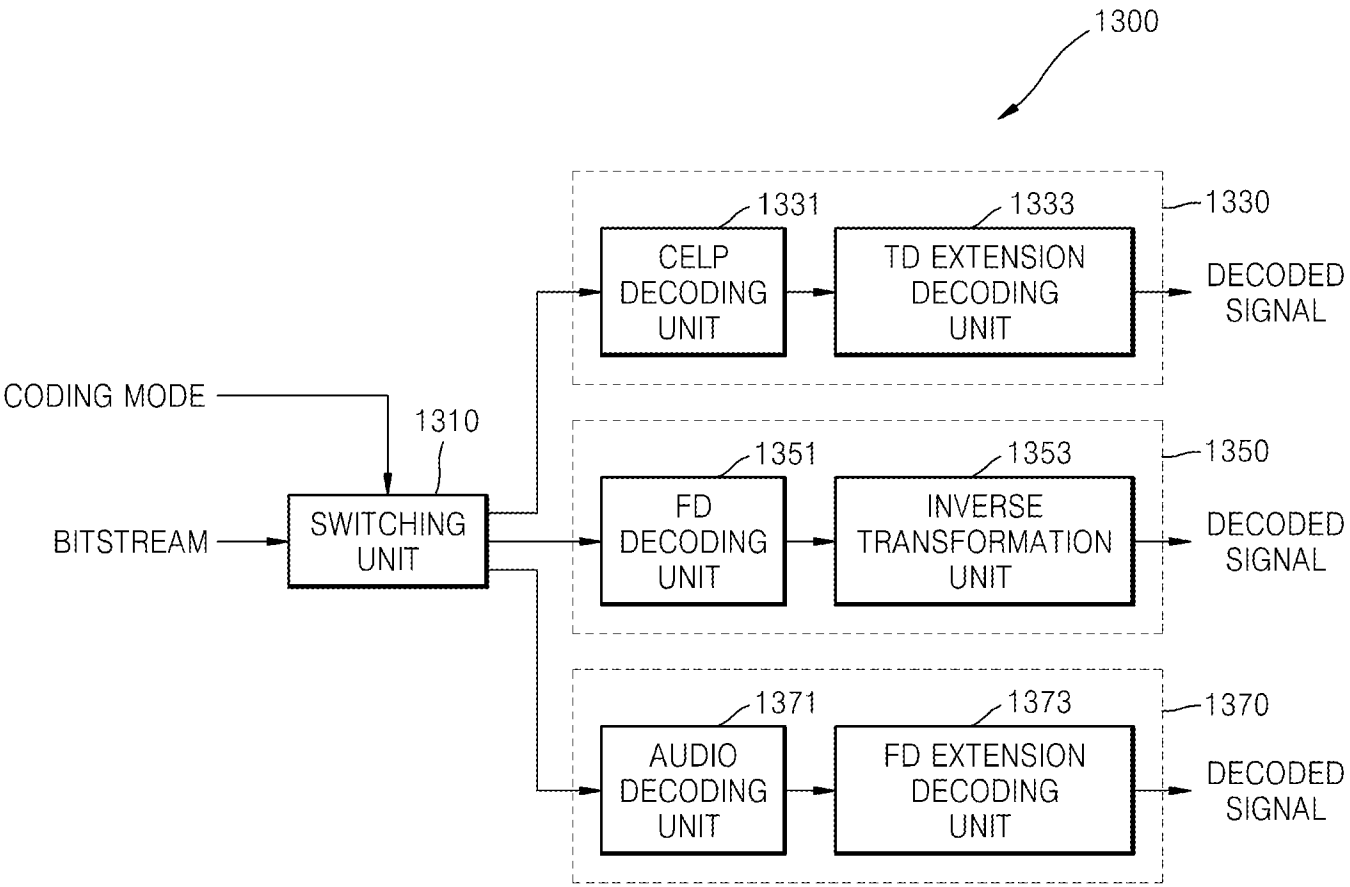
FIG. 13 shows a block diagram of an audio decoding apparatus according to another exemplary embodiment.

FIG. 13 is a block diagram of an audio decoding apparatus according to another exemplary embodiment.

The audio decoding apparatus 1300 illustrated in FIG. 13 may include a switching unit 1310, a CELP decoding module 1330, an FD decoding module 1350, and an audio decoding module 1370. The CELP decoding module 1330 may include a CELP decoding unit 1331 and a TD extension decoding unit 1333, the FD decoding module 1350 may include an FD decoding unit 1351 and an inverse transformation unit 1353, and the audio decoding module 1370 may include an audio decoding unit 1371 and an FD extension decoding unit 1373. The above elements may be integrated into at least one module and may be driven by at least one processor (not shown).

Referring to FIG. 13, the switching unit 1310 may provide a bitstream to the CELP decoding module 1330, the FD decoding module 1350, or the audio decoding module 1370 with reference to information regarding a coding mode, which is included in the bitstream. Specifically, the bitstream is provided to the CELP decoding module 1330 if the coding mode is a CELP mode, is provided to the FD decoding module 1350 if the coding mode is an FD mode, and is provided to the audio decoding module 1370 if the coding mode is an audio mode.

Here, operations of the CELP decoding module 1330, the FD decoding module 1350, and the audio decoding module 1370 are merely reversed from those of the CELP encoding module 850, the FD encoding module 870, and the audio encoding module 890 illustrated in FIG. 8, and thus detailed descriptions thereof will not be provided here.

Figure 14:
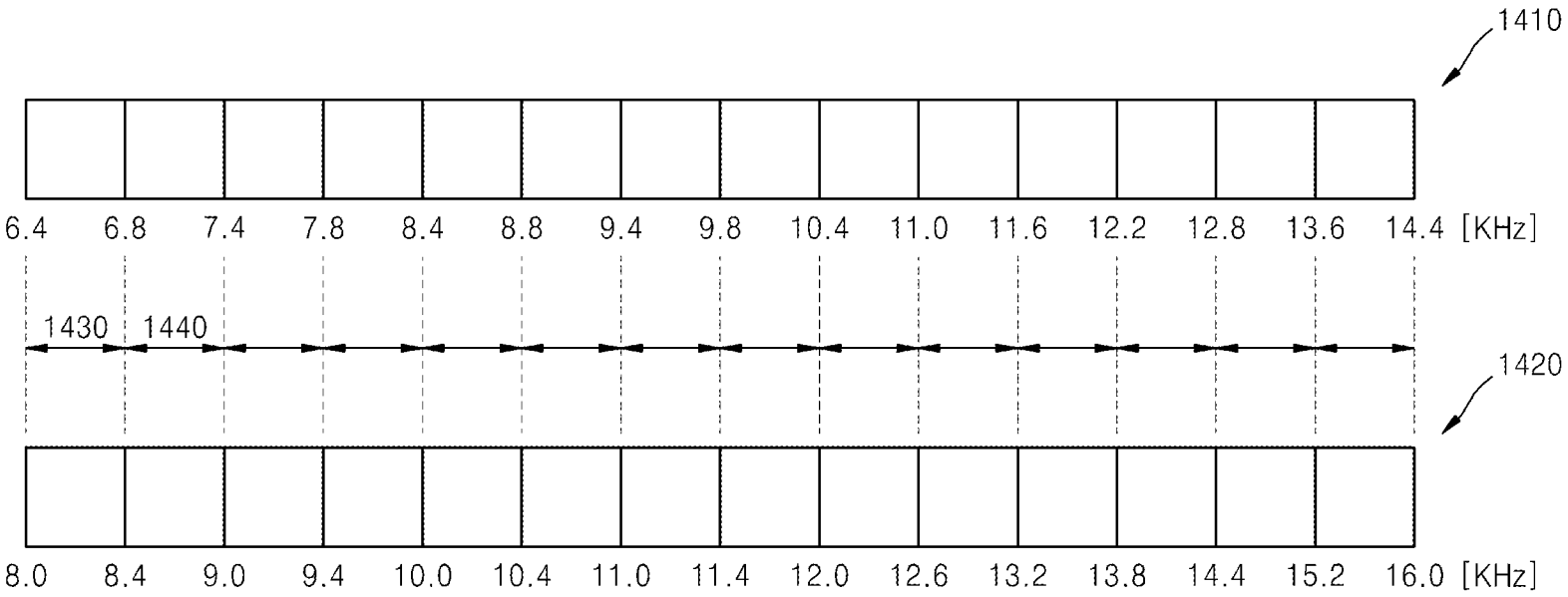
FIG. 14 shows a diagram for describing a codebook sharing method according to an exemplary embodiment.

FIG. 14 is a diagram for describing a codebook sharing method according to an exemplary embodiment.

The FD extension encoding unit 773 or 893 illustrated in FIG. 7 or 8 may perform energy quantization by sharing the same codebook with respect to different bit rates. As such, when a frequency spectrum corresponding to an input signal is divided into a predetermined number of subbands, the FD extension encoding unit 773 or 893 has the same bandwidth of a subband with respect to different bit rates.

A case 1410 when a frequency band of about 6.4 to 14.4 kHz is divided at a bit rate of 16 kbps and a case 1420 when a frequency band of about 8 to 16 kHz is divided at a bit rate greater than 16 kbps will now be described as examples.

Specifically, a bandwidth 1430 of a first subband at the bit rate of 16 kbps and the bit rate greater than 16 kbps may be 0.4 kHz, and a bandwidth 1440 of a second subband at the bit rate of 16 kbps and the bit rate greater than 16 kbps may be 0.6 kHz.

As such, if a subband has the same bandwidth with respect to different bit rates, the FD extension encoding unit 773 or 893 may perform energy quantization by sharing the same codebook with respect to different bit rates.

Consequently, in a configuration when a CELP mode and an FD mode are switched, a CELP mode and an audio mode are switched, or a CELP mode, an FD mode, and an audio mode are switched, a multimode bandwidth extension method may be used and a codebook for supporting various bit rates may be shared, thereby reducing the size of memory (e.g., ROM) and also reducing the complexity of implementation.

Figure 15:
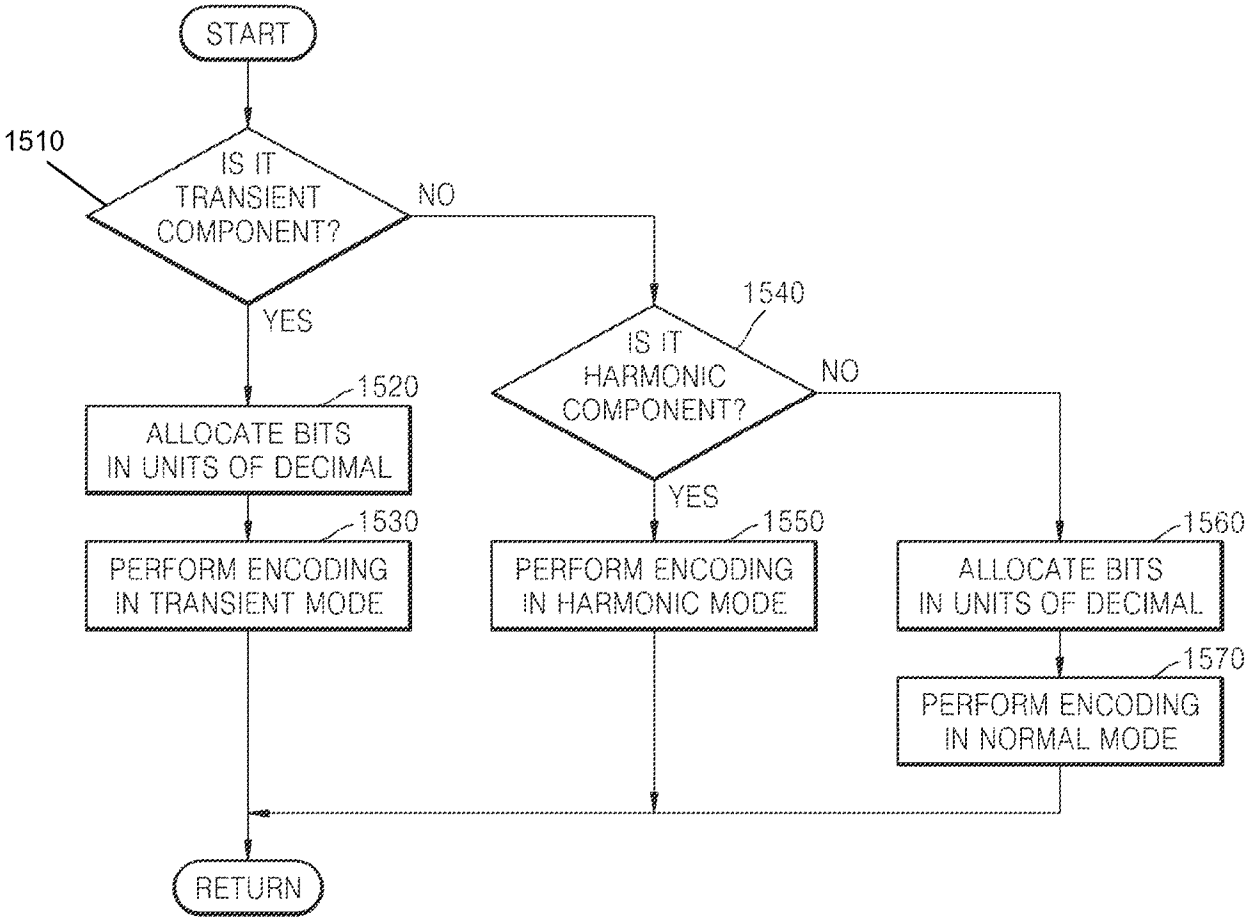
FIG. 15 shows a diagram for describing a coding mode signaling method according to an exemplary embodiment.

FIG. 15 is a diagram for describing a coding mode signaling method according to an exemplary embodiment.

Referring to FIG. 15, in operation 1510, it is determined whether an input signal corresponds to a transient component by using various well-known methods.

In operation 1520, if it is determined that the input signal corresponds to a transient component in operation 1510, bits are allocated in units of a decimal.

In operation 1530, the input signal is encoded in a transient mode, and it is signaled that encoding has been performed in a transient mode, by using a 1-bit transient indicator.

Meanwhile, in operation 1540, if it is determined that the input signal does not correspond to a transient component in operation 1510, it is determined whether the input signal corresponds to a harmonic component by using various well-known methods.

In operation 1550, if it is determined that the input signal corresponds to a harmonic component in operation 1540, the input signal is encoded in a harmonic mode and it is signaled that encoding has been performed in a harmonic mode, by using a 1-bit harmonic indicator together with a 1-bit transient indicator.

Meanwhile, in operation 1560, if it is determined that the input signal does not correspond to a harmonic component in operation 1540, bits are allocated in units of decimal.

In operation 1570, the input signal is encoded in a normal mode and it is signaled that encoding has been performed in a normal mode, by using a 1-bit harmonic indicator together with a 1-bit transient indicator.

That is, three modes, i.e., a transient mode, a harmonic mode, and a normal mode, may be signaled by using a 2-bit indicator.

Methods performed by the above apparatuses can be written as computer programs and can be implemented in general-use digital computers that execute the programs using a computer readable recording medium including program instructions for executing various operations realized by a computer. The computer readable recording medium may include program instructions, a data file, and a data structure, separately or cooperatively. The program instructions and the media may be those specially designed and constructed for the purposes of the present inventive concept, or they may be of the kind well known and available to one of ordinary skill in the art of computer software arts. Examples of the computer readable media include magnetic media (e.g., hard disks, floppy disks, and magnetic tapes), optical media (e.g., CD-ROMs or DVD), magneto-optical media (e.g., floptical disks), and hardware devices (e.g., ROMs, RAMs, or flash memories, etc.) that are specially configured to store and perform program instructions. The media may also be transmission media such as optical or metallic lines, wave guides, etc. specifying the program instructions, data structures, etc. Examples of the program instructions include both machine code, such as produced by a compiler, and files containing high-level languages codes that may be executed by the computer using an interpreter.

While the present inventive concept has been particularly shown and described with reference to exemplary embodiments thereof, it will be understood by one of ordinary skill in the art that various changes in form and details may be made therein without departing from the spirit and scope of the inventive concept as defined by the following claims and their equivalents.

What is claimed is:

1. A method of generating a bandwidth extended signal, the method comprising:

performing noise filling on a decoded low-frequency spectrum;

performing anti-sparseness processing by which a constant value is inserted into spectral coefficients remaining zero in the decoded low-frequency spectrum on which the noise filling is performed;

generating a high-frequency spectrum by using the decoded low-frequency spectrum on which the anti-sparseness processing is performed; and combining the decoded low-frequency spectrum on which the noise filling is performed and the generated high-frequency spectrum.

2. The method of claim 1, wherein the constant value is inserted based on a random seed.

3. The method of claim 2, wherein the constant value has a random sign.

4. The method of claim 3, wherein the generating of the high-frequency spectrum is performed based on an excitation type information included in a bitstream.

5. The method of claim 4, wherein the excitation type information is assigned in units of frame.

6. The method of claim 4, wherein the excitation type information is determined based on signal characteristics.

7. A non-transitory computer readable medium comprising computer readable code executable by a processor to perform the method of claim 1.

* * * * *